US012454882B1

(12) United States Patent
Warren et al.

(10) Patent No.: US 12,454,882 B1
(45) Date of Patent: Oct. 28, 2025

(54) METHOD TO REDUCE PEAK TREATMENT CONSTITUENTS IN SIMULTANEOUS TREATMENT OF MULTIPLE WELLS

(71) Applicant: Halliburton Energy Services, Inc., Houston, TX (US)

(72) Inventors: Wesley John Warren, Duncan, OK (US); Chad A. Fisher, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/650,571

(22) Filed: Apr. 30, 2024

(51) Int. Cl.
*E21B 43/12* (2006.01)
*E21B 43/26* (2006.01)
*F04B 49/00* (2006.01)

(52) U.S. Cl.
CPC ..... *E21B 43/2607* (2020.05)

(58) Field of Classification Search
CPC ..... E21B 43/2607; E21B 43/12; E21B 43/26; F04B 49/00; F04B 17/03; F04B 17/05; F04B 23/04; F04B 49/06
USPC ..... 166/308.1
See application file for complete search history.

(56) References Cited

U.S. PATENT DOCUMENTS 8,490,685 B2 * 7/2013 Tolman ..... E21B 43/267 166/52
11,506,032 B1 * 11/2022 Fisher ..... E21B 43/2607
11,519,252 B2 12/2022 Kramer et al.
11,639,653 B2 * 5/2023 Bolen ..... F16L 41/03 166/52
11,885,208 B2 * 1/2024 Kohli ..... F04B 17/06
2017/0370199 A1 * 12/2017 Witkowski ..... F04B 15/02
2021/0310346 A1 * 10/2021 Bull ..... E21B 43/2607
2021/0355801 A1 11/2021 Yeung et al.
2021/0396117 A1 12/2021 Yeung et al.
(Continued)

FOREIGN PATENT DOCUMENTS

WO 2020097060 A2 5/2020

OTHER PUBLICATIONS

Foreign Communication from Related Application—International Search Report and Written Opinion of the International Searching Authority, International Application No. PCT/US2024/031248, dated Jan. 22, 2025, 11 pages.

*Primary Examiner* — Nicole Coy
*Assistant Examiner* — Douglas S Wood
(74) *Attorney, Agent, or Firm* — Conley Rose, P.C.; Rodney B. Carroll

(57) ABSTRACT

A method of controlling a pumping sequence of a fracturing fleet at a wellsite with three or more wellbores comprising determining first, second, and third pumping sequences for a first, second, and third wellbore. The pumping sequences are comprised of a plurality of pump stages that are intervals based on time or volume. The intervals of the first, second, and third pumping sequences are overlapped into a combined pumping sequence. Each of the plurality of intervals of the modified combined pumping sequence is below an operating limit of at least one fracturing unit of the fracturing fleet. The method can include identifying at least one interval wherein the combined pumping sequence exceeds an operating limit of at least one fracturing unit of the fracturing fleet, wherein the at least one interval of the modified combined pumping sequence is below the operating limit.

20 Claims, 10 Drawing Sheets

(56) References Cited

U.S. PATENT DOCUMENTS

| | | | | |
|---|---|---|---|---|
| 2022/0003229 | A1* | 1/2022 | Mu | F04B 47/02 |
| 2022/0112796 | A1* | 4/2022 | Jaaskelainen | E21B 43/26 |
| 2023/0266747 | A1 | 8/2023 | Jaaskelainen et al. | |
| 2024/0018859 | A1* | 1/2024 | Sun | F04B 17/03 |
| 2024/0026764 | A1* | 1/2024 | Sun | F04B 23/04 |

* cited by examiner

METHOD TO REDUCE PEAK TREATMENT CONSTITUENTS IN SIMULTANEOUS TREATMENT OF MULTIPLE WELLS

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Subterranean hydraulic fracturing is conducted to increase or "stimulate" production from a hydrocarbon well. To conduct a fracturing process, high pressure is used to pump special fracturing fluids, including some that contain propping agents ("proppants") down-hole and into a hydrocarbon formation to split or "fracture" the rock formation along veins or planes extending from the well-bore. Once the desired fracture is formed, the fluid flow is reversed and the liquid portion of the fracturing fluid is removed. The proppants are intentionally left behind to stop the fracture from closing onto itself due to the weight and stresses within the formation. The proppants thus literally "prop-apart", or support the fracture to stay open, yet remain highly permeable to hydrocarbon fluid flow since they form a packed bed of particles with interstitial void space connectivity. Sand is one example of a commonly-used proppant. The newly-created-and-propped fracture or fractures can thus serve as new formation drainage area and new flow conduits from the formation to the well, providing for an increased fluid flow rate, and hence increased production of hydrocarbons.

Three or more wells clustered together can be stimulated simultaneously with the same fracturing equipment. A need exists to stimulate multiple (e.g., three or more) wellbores simultaneously without exceeding pumping limits of available fracturing equipment.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
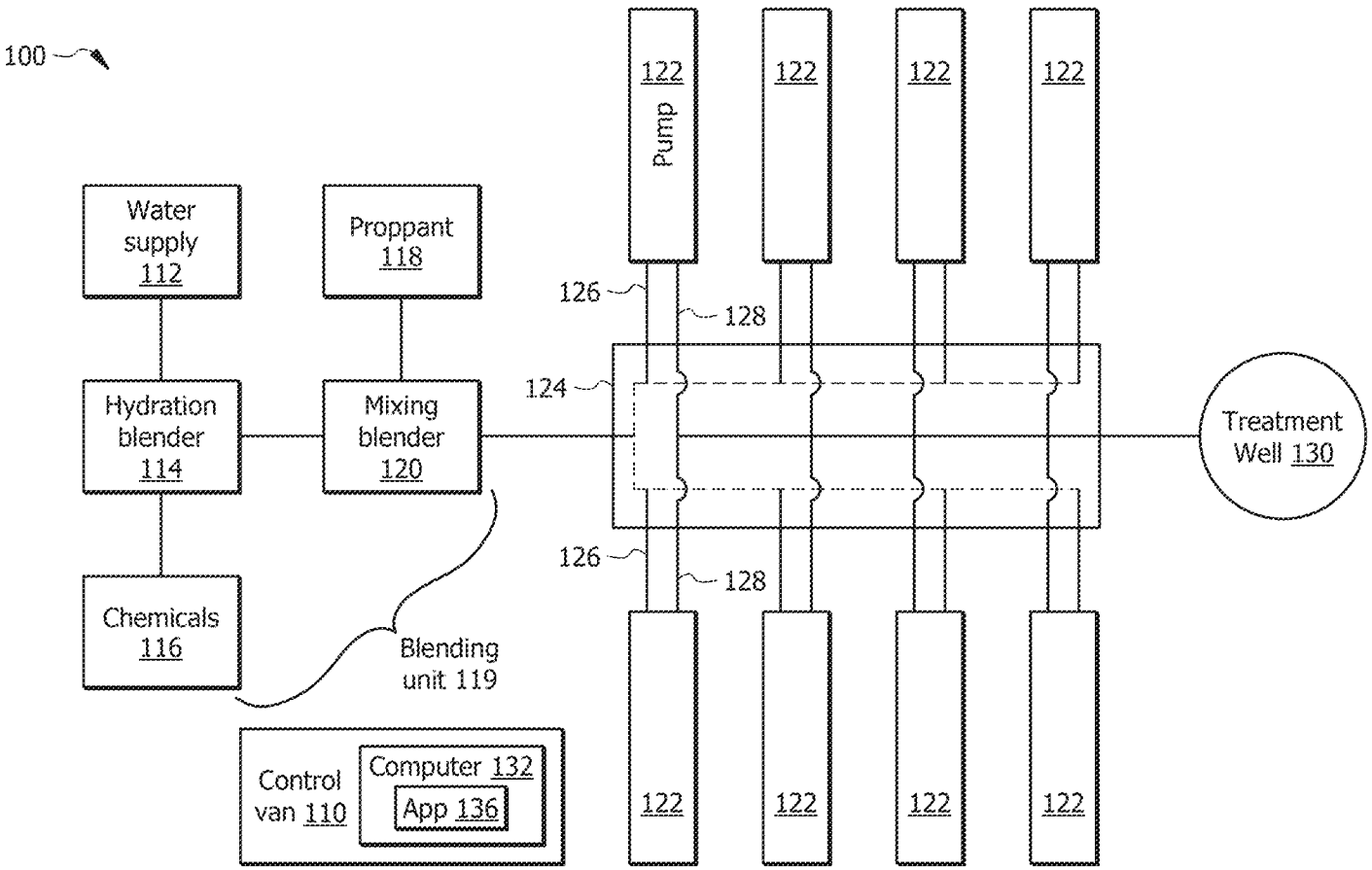
FIG. 1 is a block diagram of a hydraulic fracturing system treating one well according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

When simultaneously fracturing multiple wells, a required capacity of the (e.g., blending) equipment may be exceeded. This can be particularly relevant when the (e.g., blending) equipment is of a legacy type originally intended for single well operations. Additionally, when hydraulically fracturing wells, several treatment parameters can change during the treatment. For example, parameters such as water rate, sand rate and chemical additive rates may sequentially increase as the treatment progresses. Furthermore, when simultaneously fracturing multiple wells it has been conventional to start the treatment of all simultaneously fractured wells at the same time and follow the same treatment schedule for all wells. This conventional operation can lead to wide swings in the total water, sand, and chemical rates, etc., required during the treatment (e.g., with low rates near the start and high rates near the end of the treatment), which can lead to exceeding an operating parameter of the fracturing equipment (e.g., an available rate limit, as shown and described hereinbelow with reference to FIG. 8).

The herein disclosed system and method comprise introducing a time offset in the start time of the treatments for multiple (e.g., two, three, four, or more) wells being treated simultaneously so that the time offset reduces the maximum rate requirements from the blending equipment. In embodiments, the offset(s) can be devised to level (e.g., reduce variation or variability of) the operating parameter for (at least a portion of) the duration of the treatments of the multiple wells being treated simultaneously, and/or provide a buffer between the maximum (e.g., rate) requirements from the blending equipment and a maximum available parameter (e.g., a maximum available rate).

A modern fracturing fleet typically includes a water supply, a proppant supply, one or more blenders, a plurality of frac pumps, and a fracturing manifold connected to the wellhead. The individual units of the fracturing fleet can be connected to a central control unit called a data van. The control unit can control the individual units of the fracturing fleet to provide proppant slurry at a desired rate to the wellhead. The control unit can manage the pump speeds, chemical intake, and proppant density while pumping fracturing fluids and receiving data relating to the pumping from the individual units.

Multiple well completion techniques (also referred to as "simulfrac") can be used to maximize operational use of equipment and personnel. Some oil fields have multiple wells drilled from a single pad. The placement of multiple wells within a single pad or area allows for a smaller footprint of production equipment. Multiple wells on a single pad also allows for hydraulic fracturing multiple wells without relocating the fracturing equipment. One such technique, called zipper fracturing, allows a single fracturing fleet to treat multiple wells by alternating the pumping operation from one well to another well. Another technique allows for multiple wells to be treated simultaneously. The hydraulic fracturing fleet can connect to three or more wells to pump the hydraulic fracturing treatment into the three or more wells at the same time. The pumping capacity of the available equipment may not be enough to treat all wells simultaneously. The wellsite may not be able to accommodate a fracturing fleet with enough pumping capacity to simultaneously treat the three or more wells. The available equipment may have a reduced reliability based on size, age, or time between major equipment servicing. A method to treat multiple wells with limited pumping capacity is needed.

In an embodiment, the fracturing fleet can be divided into a cleaning pumping group and a dirty pumping group. The clean pumping group pumps clean fluid or fluid without proppant. The dirty pumping group pumps dirty fluid or fluid with proppant. The clean pumping group can split the fluid output from the pumps into each of three or more wells (e.g., a first well, a second well, and a third well). The dirty pumping group can split the dirty fluid output from the pumps into each of the three or more wells (e.g., the first well, the second well, and the third well). Each well of the three or more wells (e.g., the first well, the second well, and the third well) can receive a combined treatment volume. The combined treatment volume can be designed to produce the desired fractures within the formation. The dirty pumping group can be comprised of pumping equipment with an increased reliability to reduce the chance of equipment malfunction during pumping. The clean pumping group can comprise pumping equipment with a lower reliability (e.g., equipment that is reliable, but can be less resistant to abrasion, thus lowering operating cost) than the pumping equipment used for the dirty pumping group as the clean fluid can be less abrasive and induce a lower level of stress on the pumping equipment. Utilizing pumping equipment with a reduced reliability to pump the less abrasive clean fluid can increase the pumping capacity of the frac fleet.

In an embodiment, the fluid pumping schedule can be designed to prevent peak pumping rate from exceeding the pumping capacity of the fracturing fleet. The pumping schedule can be designed to deliver a combined treatment volume comprising a clean fluid volume and a dirty fluid volume to each of three or more wells (e.g., a first well, a second well, and a third well). A fluid pumping schedule can be divided into stages that coincide with a change in pumping volume, pressure, rate, or proppant loading. The fluid pumping schedule for one or more of the three or more wells can be offset (e.g., temporally offset) relative to the fluid pumping schedule of at least one other of the three or more wells. For example, in embodiments the first well can be designed to begin a first pumping stage before the fluid pumping schedule for the second well begins the first pumping stage and/or before the fluid pumping schedule for the third well begins the first pumping stage. In embodiments, the first well can be designed to begin a first pumping stage before the fluid pumping schedule for the second well begins the first pumping stage, and the second well can be designed to begin the first pumping stage before the fluid pumping schedule for the third well begins the first pumping stage. Similarly, the fluid pumping schedule for the first well can be designed to transition from a first pumping stage to a second pumping stage before the second pumping schedule finishes the first pumping stage and/or before the third pumping schedule finishes the first pumping stage. In embodiments, the fluid pumping schedule for the first well can be designed to transition from the first pumping stage to the second pumping stage before the second pumping schedule finishes the first pumping stage, and the fluid pumping schedule for the second well can be designed to transition from the first pumping stage to the second pumping stage before the third pumping schedule finishes the first pumping stage. Offsetting the pumping stages will therefore offset the combined pumping rate delivered to the three or more wells (e.g., to the first, second, and third wells), thereby avoiding an operating limit of one or more fracturing units, while pumping the treatment into the one or more wells (e.g., into the first, second, and third wells) simultaneously.

In an embodiment, the pump sequence (also referred to herein as "pump schedule") design can assign frac units to perform the pumping sequence based on a set of criteria provided by the user. A variety of pumping equipment can be delivered to a wellsite of various ages, versions of equipment, upgrades, and modifications. For example, a second generation and a third generation of the frac pump with different pump ratings can be delivered to the wellsite. Although the equipment can be functionally identical, some equipment may be better suited for pumping the clean fluid and some equipment may be better suited for pumping the dirty fluid. The pumping sequence design can provide a solution to the optimization of equipment by selecting the optimal set of equipment for the pumping operation. The pump sequence design can produce a pump schedule that maximizes the pumping capacity of the pumping equipment to stimulate multiple wells simultaneously.

Disclosed herein is a method of performing a pumping operation on multiple wells simultaneously by maximizing the treatment capacity of the fracturing fleet based on the available equipment. A pumping schedule can be designed with a pumping sequence design method that offsets the pumping schedule of each well to avoid exceeding the treatment capacity of the fracturing fleet. The pump schedule design can assign the pumping equipment to pump the clean fluid volume or the dirty fluid volume based on user criteria.

Described herein is a typical fracturing fleet at a wellsite. The pumping sequence can be partially controlled or fully controlled by a computerized managing application with feedback of equipment data provided by sensors on the fracturing units indicative of a pumping stage of the pumping sequence. Turning now to FIG. 1, an embodiment of a hydraulic fracturing system 100 that can be utilized to pump hydraulic fracturing fluids into a wellbore, is illustrated. As depicted, a plurality of hydraulic fracturing pumps 122 (also referred to as "frac pump" or high horsepower pumps) is connected in parallel to a fracturing manifold 124 (also referred to as a "missile") to provide fracturing fluids to the treatment well 130 (also referred to as the wellhead). The fracturing fluids are typically a blend of friction reducer and water, e.g., slick water, and proppant. In some cases, a gelled fluid (e.g., water, a gelling agent, optionally a friction reducer, and/or other additives) may be created in a hydration blender 114 from the water supply unit 112 and gelling chemicals from the chemical unit 116. When slick water is used, the hydration blender 114 can be omitted. The proppant is added at a controlled rate to the gelled fluid in one or more mixing blenders 120. Each of the one or more mixing blenders 120 is in fluid communication with the manifold 124 so that the fracturing treatment is pumped into the manifold 124 for distribution to the frac pumps 122, via supply line 126. The fracturing fluids are returned to the manifold 124 from the frac pumps 122, via high pressure line 128, to be pumped into the treatment well 130 that is in fluid communication with the manifold 124. Although fracturing fluids typically contain a proppant, a portion of the pumping sequence may include a fracturing fluid without proppant (e.g., a pad fluid, clean fluid, flush fluid). Although fracturing fluids typically include a gelled fluid, the fracturing fluid may be blended without a gelling chemical. Alternatively, the fracturing fluids can be blended with an acid to produce an acid fracturing fluid, for example, pumped as part of a spearhead or acid stage that clears debris that may be present in the wellbore and/or fractures to help clear the way for fracturing fluid to access the fractures and surrounding formation.

A control van 110 can be communicatively coupled (e.g., via a wired or wireless network) to any of the frac units wherein the term "frac units" may refer to any of the plurality of frac pumps 122, a manifold 124, and associated blending unit 119 with one or more mixing blender(s) 120, proppant storage unit 118, hydration blender 114, water supply unit 112, and chemical unit 116. The managing application 136 executing on a computer (e.g., server) 132 within the control van 110 can establish unit level control over the frac units communicated via the network. Unit level control can include sending instructions to the frac units and/or receiving equipment data from the frac units. For example, the managing application 136 within the control van 110 can establish a pump rate of 25 bpm with the plurality of frac pumps 122 while receiving pressure and rate of pump crank revolutions from sensors on the frac pumps 122.

Figure 11:
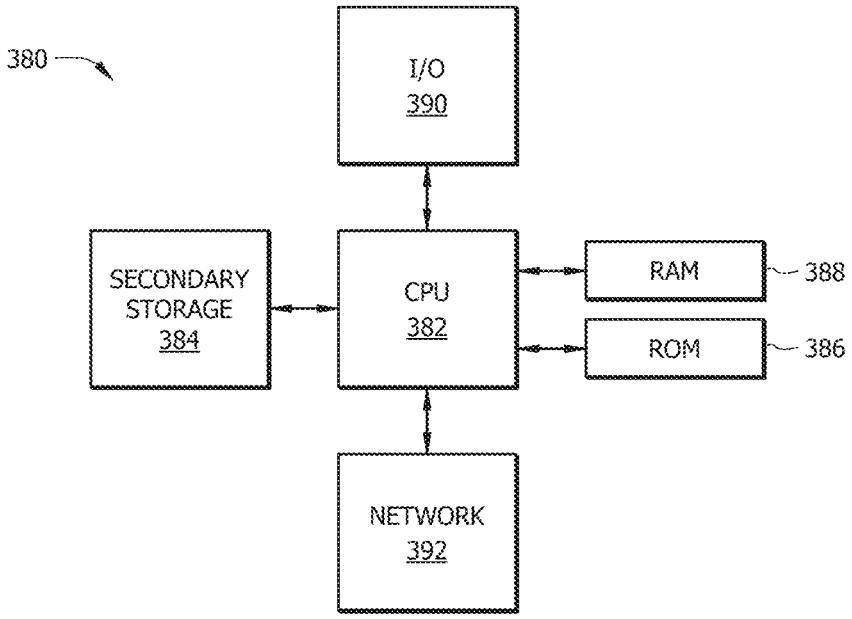
FIG. 11 is a block diagram of a computer system according to an embodiment of the disclosure.

Although the managing application 136 is described as executing on a computer 132, it is understood that the computer 132 can be a computer system, for example computer system 380 in FIG. 11, or any form of a computer system such as a server, a workstation, a desktop computer, a laptop computer, a tablet computer, a smartphone, or any other type of computing device. The computer 132 (e.g., computer system) can include one or more processors, memory, input devices, and output devices, as described in more detail further hereinafter. Although the control van 110 is described as having the managing application 136 executing on a computer 132, it is understood that the control van 110 can have 2, 3, 4, or any number of computers 132 (e.g., computer systems) with 2, 3, 4, or any number of managing applications 136 executing on the computers 132.

Figure 2:
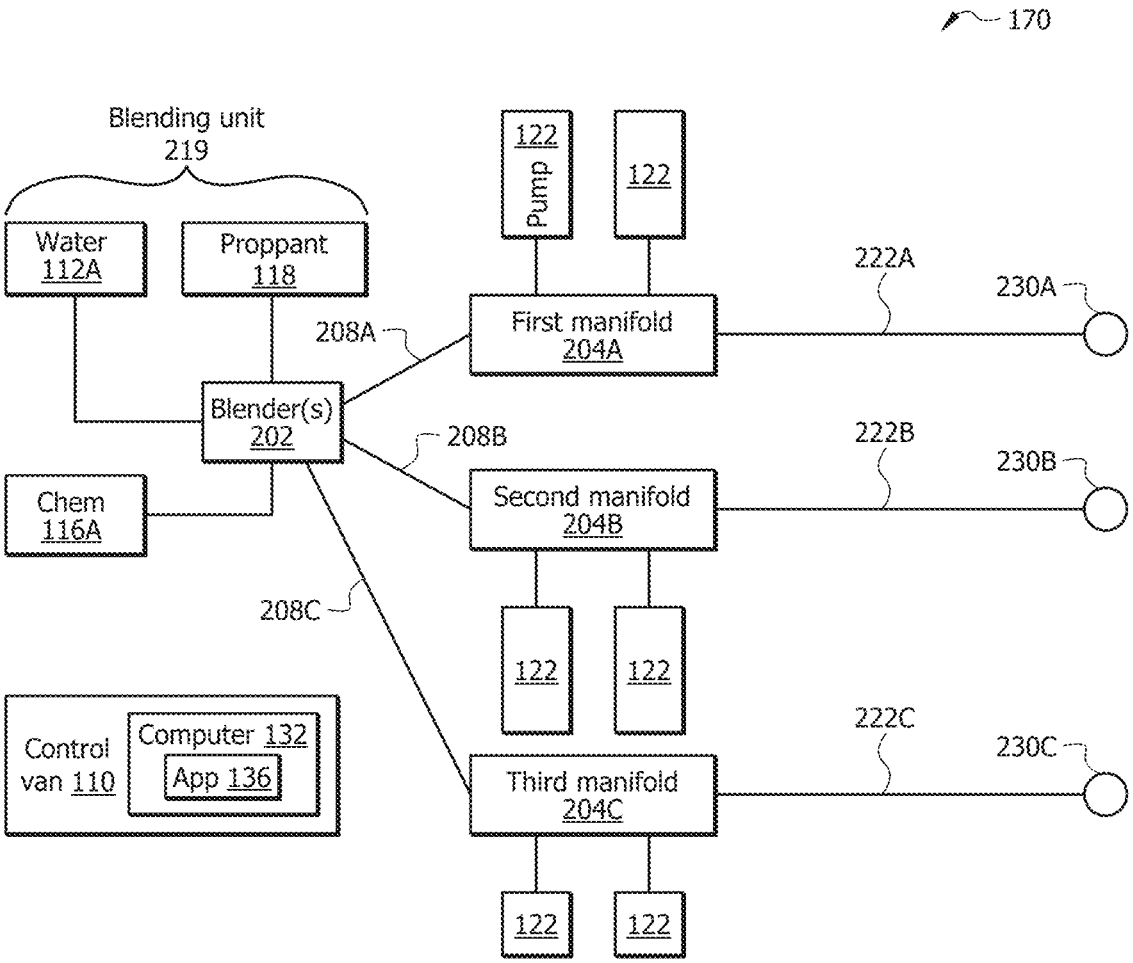
FIG. 2 is a block diagram of a hydraulic fracturing system treating three wells according to an embodiment of the disclosure.

The fracturing fleet can be divided into three pumping groups that share a blending unit 219 comprising one or more blenders 202 (e.g., mixing tubs, centrifugal blenders) to simultaneously treat three or more wells. Turning now to FIG. 2, an embodiment of a hydraulic fracturing system 170 that can be utilized to pump hydraulic fracturing fluids into three wellbores, is illustrated. As depicted, the blender capacity can be divided among three sets of frac pumps. A first set of frac pumps 122 can be connected to a first manifold 204A. A second set of frac pumps 122 can be connected to a second manifold 204B. A third set of frac pumps 122 can be connected to a third manifold 204C. As previously described, each mixing blender 202 of the blending unit 219 can produce a proppant slurry by adding proppant, e.g., sand, from the proppant storage unit 118 to slick water blended from water provided by the water supply 112A and a friction reducer from the chemical unit 116A. A portion of the proppant slurry from the blending unit 219 can be pumped through feed line 208A to the first manifold 204A and first set of frac pumps 122, a portion of the proppant slurry from the blending unit 219 can be pumped through feed line 208B to the second manifold 204B and second set of frac pumps 122, and a portion of the proppant slurry from the blending unit 219 can be pumped through feed line 208C to the third manifold 204C and second set of frac pumps 122. The total volumetric rate of slurry received by the first wellbore 230A, the second wellbore 230B, and the third wellbore 230C cannot exceed the total volumetric rate output of the blending unit 219 The volumetric rate output of the mixing blender(s) 202 can be limited by the maximum proppant, e.g., sand, mixing rate of the mixing blender(s) 202. A plurality of frac pumps 122 are connected in parallel to the first manifold 204A. Likewise, a plurality of frac pumps 122 are connected in parallel to the second manifold 204B, and a plurality of frac pumps 122 are connected in parallel to the third manifold 204C. Although two frac pumps 122 are shown, it is understood that 1, 2, 4, 8, 16, or any number of frac pumps 122 can connect in parallel to first manifold 204A, second manifold 204B, and third manifold 204C.

A first wellbore 230A can receive a volume of proppant slurry from the first manifold 204A via high pressure line 222A. A second wellbore 230B can receive a volume of proppant slurry from the second manifold 204B via high pressure line 222B. A third wellbore 230C can receive a volume of proppant slurry from the third manifold 204C via high pressure line 222C. If the mixing blender 202 is a single mixing source, e.g., a single tub, the proppant slurry received by the first wellbore 230A can have the same fluid properties as the proppant slurry received by the second wellbore 230B and third wellbore 230C. Alternatively, if the mixing blender 202 is a dual mixing source, e.g., two tubs, and/or the bending unit 219 comprises a fluid proportioner as described in U.S. patent application Ser. No. 18/632,633, filed Apr. 11, 2024 and entitled "Slurry Proportioner System" or a multi-well blending system, for example, as described in U.S. patent Ser. No. 18/632,640, filed and Apr. 11, 2024 and entitled "Multi-Well Blending System", the disclosure of each of which is hereby incorporated herein for purposes not contrary to this disclosure, the proppant slurry received by the first wellbore 230A (e.g., mixed in a first tub of the blender) can have different fluid properties than the proppant slurry received by the second wellbore 230B (e.g., mixed in a second tub of the blender) and/or the proppant slurry received by the third wellbore 230C (e.g., mixed in a third tub of the blender). In embodiments, one blender 202 can provide different slurries to each of the first wellbore 230A, the second wellbore 230B, and the third wellbore 230C.

A control van (e.g., control van 110 from FIG. 1) can be communicatively coupled (e.g., via a wired or wireless network) to all of the frac units, wherein the term "frac units" may refer to any of the plurality of frac pumps 122, a manifold (e.g., first 204A, second 204B, third manifold 204C), mixing blender(s) (e.g., 202) and associated proppant storage unit(s) 118 (and/or a proppant delivery unit (such as an ExpressSand™ structure available from Halliburton Energy Services, Inc.) or a proppant transfer or metering unit (such as a conveyor belt, auger, or metering gate), water supply unit(s) (e.g., 112A), and chemical unit(s) (e.g., 116A). The managing application 136 executing on a computer (e.g., server) 132 within the control van 110 can establish unit level control over the frac units communicated via the network. Unit level control can include sending instructions to the frac units and/or receiving equipment data from the frac units.

Figure 3:
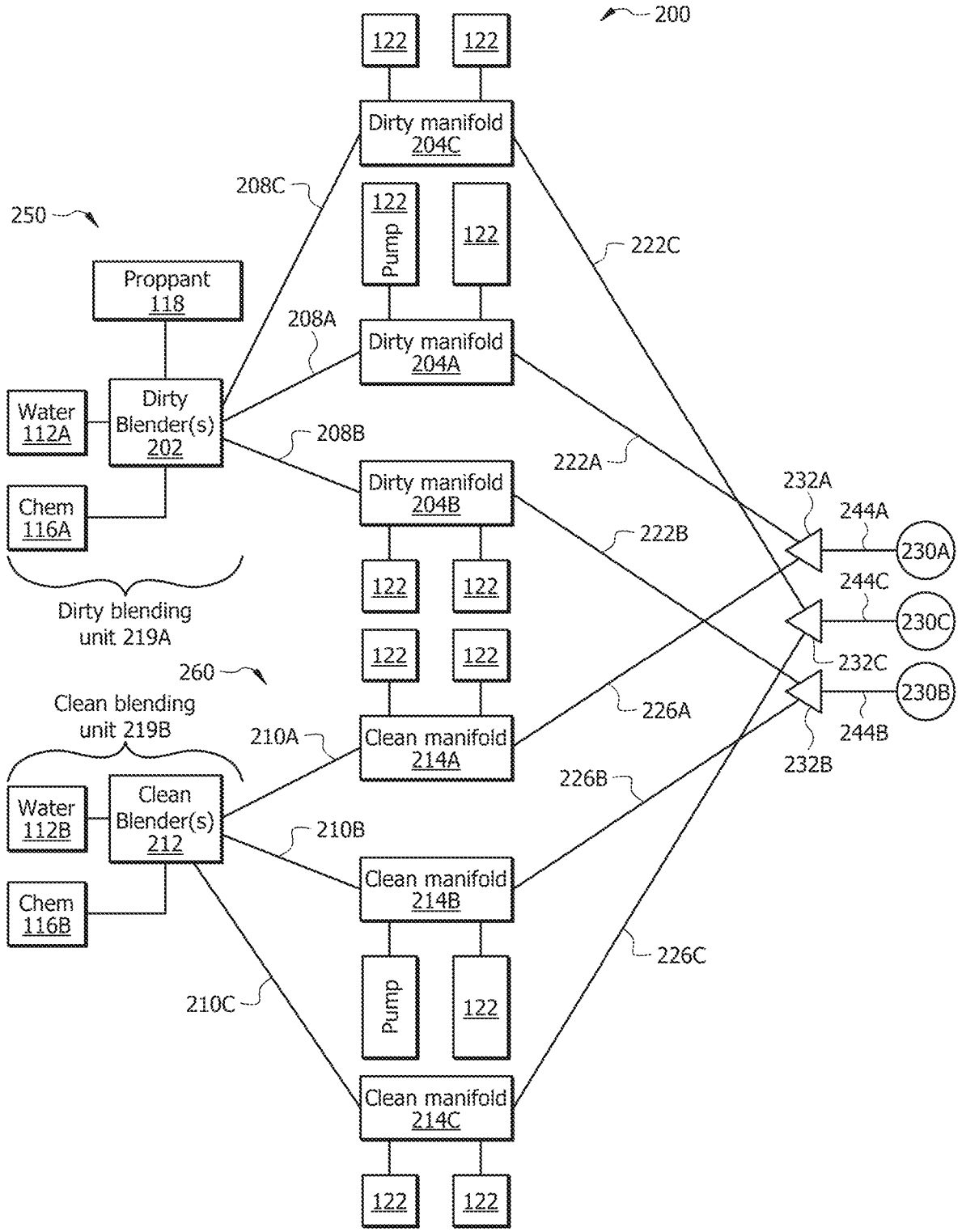
FIG. 3 is a block diagram of a hydraulic fracturing system treating three wells with two pumping groups according to an embodiment of the disclosure.

The fracturing fleet can be divided into a clean pumping group and a dirty pumping group to increase the pumping capacity of the available pumping equipment. Turning now to FIG. 3, an embodiment of a hydraulic fracturing system 200 that can be utilized to pump hydraulic fracturing fluids into three wellbores, is illustrated. As depicted, the pumping capacity of the fracturing fleet can be divided into a dirty fluid group 250 and a clean fluid group 260. The dirty fluid group 250 can comprise a dirty blending unit 219A comprising dirty blender(s) 202 (e.g., a mixing blender) connected to a first manifold 204A, a second manifold 204B, and a third manifold 204C. As previously described, the dirty blender(s) 202 can produce a proppant slurry by adding proppant from the proppant storage unit 118 to a gelled fluid blended from water provided by the water supply 112A and gelling chemicals or friction reducers from the chemical unit 116A. The proppant slurry, e.g., the dirty fluid, can be pumped through feed line 208A to first dirty manifold 204, feed line 208B to second dirty manifold 204B, and feed line 208C to third dirty manifold 204C. A plurality of frac pumps 122 are connected in parallel to first manifold 204A, second manifold 204B, and third manifold 204C. The clean fluid group 260 can comprise a clean blending unit 219B including clean blender(s) 212 (e.g., a mixing blender) connected to a first clean manifold 214A, a second clean manifold 214B, and a third clean manifold 214C. In some cases, the clean blender(s) 212 can be replaced with a boost pump, e.g., centrifugal pump, with chemical port to receive a chemical additive, such as a friction reducer. As previously described, the clean blender(s) 212 can produce a slick water fluid blended from water provided by the water supply 112B and friction reducer chemicals from the chemical unit 116B. The slick water fluid, e.g., the clean fluid, can be pumped through feed line 210A to first clean manifold 214A, e.g., third manifold 214A, feed line 210B to second clean manifold 214B, e.g., fifth manifold 214B, and feed line 210C to third clean manifold 214C, e.g., sixth manifold 214C. A plurality of frac pumps 122 can connect in parallel to fourth manifold 214A, fifth manifold 214B, and sixth manifold 214C.

A first wellbore 230A can receive a combined treatment volume comprising a clean fluid volume and a dirty fluid volume from the clean fluid group 260 and the dirty fluid group 250. The dirty fluid group 250 can provide a dirty fluid volume via the first manifold 204A fluidly connected to a wye block 232A by high pressure line 222A. The clean fluid group 260 can provide a clean fluid volume via the first clean manifold 214A, e.g., fourth manifold 214A, fluidly connected to the wye block 232A by high pressure line 226A. High pressure connector 244A delivers the combined treatment volume from the wye block 232A to the first wellbore 230A. The wye block 232A can be a solid block, a manifold, a tubing branch, or any suitable high pressure connection.

A second wellbore 230B can receive a combined treatment volume comprising a clean fluid volume and a dirty fluid volume from the clean fluid group 260 and the dirty fluid group 250. The dirty fluid group 250 can provide a dirty fluid volume via the second dirty manifold 204B fluidly connected to a wye block 232B by high pressure line 222B. The clean fluid group 260 can provide a clean fluid volume via the fifth manifold 214B fluidly connected to the wye block 232B by high pressure line 222B. High pressure connector 244B delivers the combined treatment volume from the wye block 232B to the second wellbore 230B. The wye block 232B can be a solid block, a manifold, a tubing branch, or any suitable high pressure connection.

A third wellbore 230C can receive a combined treatment volume comprising a clean fluid volume and a dirty fluid volume from the clean fluid group 260 and the dirty fluid group 250. The dirty fluid group 250 can provide a dirty fluid volume via the third dirty manifold 204C fluidly connected to a wye block 232C by high pressure line 222C. The clean fluid group 260 can provide a clean fluid volume via the sixth manifold 214C fluidly connected to the wye block 232C by high pressure line 222C. High pressure connector 244C delivers the combined treatment volume from the wye block 232C to the third wellbore 230C. The wye block 232C can be a solid block, a manifold, a tubing branch, or any suitable high pressure connection.

Alternatively, a combination manifold can be used to combine the dirty fluid volume and clean fluid volume to a single output. A combination manifold comprises a clean low pressure side manifold, e.g., 214A, 214B, 214C, a dirty low pressure side manifold, e.g., 204A, 204B, 204C, and a unitary high pressure manifold that combines the fluid outputs of the pumps 122 to a single high pressure line fluidly connected to a wellbore (e.g., first wellbore 230A, second wellbore 230B, and third wellbore 230C).

A first combination manifold can comprise the clean low pressure side manifold 214A fluidly connected to a clean group of pumps 122 via supply line 126 and the dirty low pressure side manifold 204A fluidly connected to a dirty group of pumps 122 via supply line 126 (as shown in FIG. 1). The dirty low pressure side manifold 204A can be fluidly connected to the dirty blender 202 via supply line 208A. The clean low pressure side manifold 214A can be fluidly connected to the clean blender 212 via supply line 210A. The high pressure output from the clean group of pumps 122 and dirty group of pumps 122, connected to the combination manifold, can fluidly connect via high pressure line 128 (as shown in FIG. 1) to a unitary manifold output. The high pressure line 222A and 226A can be replaced by high pressure line 244A connecting the combination manifold to the first wellbore 230A.

A second combination manifold can comprise the clean low pressure side manifold 214B fluidly connected to a clean group of pumps 122 via supply line 126 and the dirty low pressure side manifold 204B fluidly connected to a dirty group of pumps 122 via supply line 126 (as shown in FIG. 1). The dirty low pressure side manifold 204B can be fluidly connected to the dirty blender 202 via supply line 208B. The clean low pressure side manifold 214B can be fluidly connected to the clean blender 212 via supply line 210B. The high pressure output from the clean group of pumps 122 and dirty group of pumps 122, connected to the combination manifold, can fluidly connect via high pressure line 128 (as shown in FIG. 1) to a unitary manifold output. The high pressure line 222B and 226B can be replaced by high pressure line 244B connecting the combination manifold to the second wellbore 230B.

A third combination manifold can comprise the clean low pressure side manifold 214C fluidly connected to a clean group of pumps 122 via supply line 126 and the dirty low pressure side manifold 204C fluidly connected to a dirty group of pumps 122 via supply line 126 (as shown in FIG. 1). The dirty low pressure side manifold 204C can be fluidly connected to the dirty blender 202 via supply line 208C. The clean low pressure side manifold 214C can be fluidly connected to the clean blender 212 via supply line 210C. The high pressure output from the clean group of pumps 122 and dirty group of pumps 122, connected to the combination manifold, can fluidly connect via high pressure line 128 (as shown in FIG. 1) to a unitary manifold output. The high pressure line 222C and 226C can be replaced by high pressure line 244C connecting the combination manifold to the third wellbore 230C.

A control van (e.g., control van 110 from FIG. 1) can be communicatively coupled (e.g., via a wired or wireless network) to any of the clean frac units or dirty frac units, wherein the term "frac units" may refer to any of the plurality of frac pumps 122, a manifold (e.g., 204A, 204B, 204C, 214A, 214B, 214C), a mixing blender(s) (e.g., 202 and 212), and associated proppant storage unit 118, water supply unit (e.g., 112A, 112B), and chemical unit (e.g., 116A, 116B). The managing application 136 executing on a computer (e.g., server) 132 within the control van 110 can establish unit level control over the frac units communicated via the network. Unit level control can include sending instructions to the frac units and/or receiving equipment data from the frac units.

Figure 4:
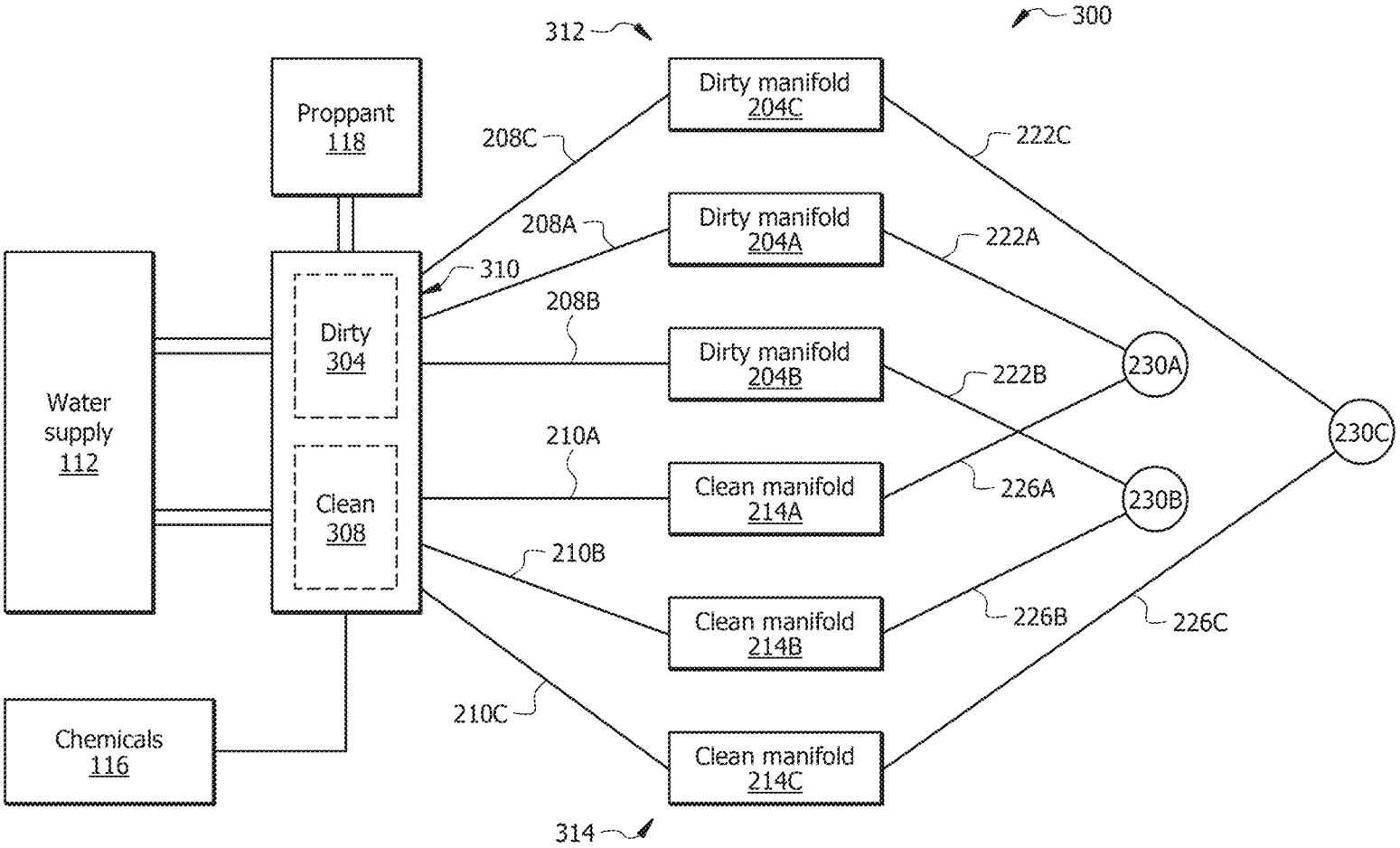
FIG. 4 is a block diagram of a hydraulic fracturing system treating three wells with two pumping groups according to another embodiment of the disclosure.

An alternate embodiment of a fracturing fleet with a clean pumping group and a dirty pumping group can utilize a single blender. Turning now to FIG. 4, an embodiment of a hydraulic fracturing system 300 that can be utilized to pump hydraulic fracturing fluids into three or more wellbores, is illustrated. As depicted, the fracturing fleet can utilize a combined mix blender 310, e.g., a two tub blender and/or a fluid proportioner as noted herein, to supply fracturing fluids to a dirty fluid group 312 and a clean fluid group 314. The dirty fluid group 312 can comprise a dirty side blender 304 (e.g., a mixing blender) connected to a first manifold 204A, a second manifold 204B, and a third manifold 204C. Although the frac pumps 122 are not illustrated, it is understood that one or more pumps can be fluidly connected to each manifold, e.g., the first manifold 204A, the second manifold 204B, and the third manifold 204C. The clean fluid group 314 can comprise a clean side blender 308 (e.g., a mixing blender) connected to a fourth manifold 214A, a fifth manifold 214B, and a sixth manifold 214C. The clean side blender 308 can be a boost pump, e.g., centrifugal pump, with chemical port to receive a chemical additive, such as a friction reducer. Although the frac pumps 122 are not illustrated, it is understood that one or more pumps can be fluidly connected to each manifold, e.g., the fourth manifold 214A, the fifth manifold 214B, and the sixth manifold 214C. Slick water can be created within the clean side blender 308 and the dirty side blender 304 with water from the water supply unit 112 and gelling chemicals from the chemical unit 116. The dirty side blender 304 can mix proppant from the proppant storage unit 118 to create the proppant slurry, e.g., the dirty fluid. The first manifold 204A, the second manifold 204B, and the third manifold 204C can receive the dirty fluid from the dirty side blender 304 via the feed lines 208A, 208B, and 208C, respectively. The fourth manifold 214A, the fifth manifold 214B, and the sixth manifold 214C can receive the clean fluid from the clean side blender 308. As previously described, the first wellbore 230A can receive the high pressure proppant slurry from the first manifold 204A via high pressure line 222A and high pressure gelled fluid from the fourth manifold 214A via the high pressure line 226A. The second wellbore 230B can receive the high pressure proppant slurry from the second manifold 204B via high pressure line 222B and high pressure gelled fluid from the fifth manifold 214B via the high pressure line 222B. The third wellbore 230C can receive the high pressure proppant slurry from the third manifold 204C via high pressure line 222C and high pressure gelled fluid from the sixth manifold 214C via the high pressure line 226C. Wye blocks 232A, 232B, and 232C can be used as described with reference to FIG. 3.

Alternatively, a combination manifold can be used to combine the dirty fluid volume and clean fluid volume to a single output. As previously disclosed, a combination manifold comprises a clean low pressure side manifold, e.g., 214A, 214B, 214C, a dirty low pressure side manifold, e.g., 204A, 204B, 204C, and a unitary high pressure manifold that combines the fluid outputs of the pumps 122 to a single high pressure line fluidly connected to a wellbore (e.g., 230A, 230B, 230C). A first combination blender can supply fluid to both a dirty low pressure side manifold 204A and clean low pressure side manifold 214A which supply fluid to a dirty group of pumps 122 and a clean group of pumps 122 with a combined output to a unitary manifold output fluidly connected to the first wellbore 230A. A second combination blender can supply fluid to both a dirty low pressure side manifold 204B and clean low pressure side manifold 214B which supply fluid to a dirty group of pumps 122 and a clean group of pumps 122 with a combined output to a unitary manifold output fluidly connected to the second wellbore 230B. A third combination blender can supply fluid to both a dirty low pressure side manifold 204C and clean low pressure side manifold 214C which supply fluid to a dirty group of pumps 122 and a clean group of pumps 122 with a combined output to a unitary manifold output fluidly connected to the third wellbore 230C.

Figure 5:
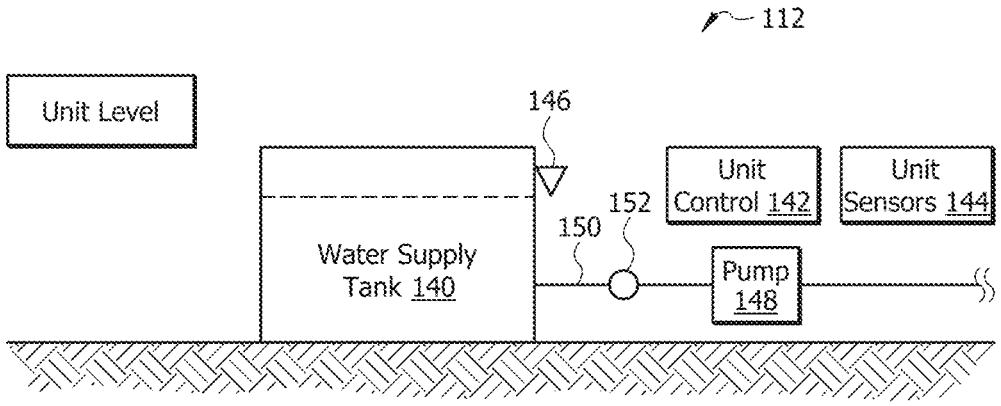
FIG. 5 is a block diagram of a water supply unit for a hydraulic fracturing system according to an embodiment of the disclosure.

Turning now to FIG. 5, an example of unit level control of the frac units is illustrated. As an example, the water supply unit 112 includes a water supply tank 140, a unit control module 142, a unit sensor module 144, a water supply pump 148, and a pipeline 150. The unit control module 142 (e.g., microprocessor controller) is in communication with and can operate the water supply pump 148 and an isolation valve 152. The unit sensors module 144 is in communication with and can receive periodic sensor data from various sensors including temperature, pressure, flow rate, density, viscosity, chemical, vibration, strain, accelerometers, exhaust, acoustic, fluid level, equipment identity, and any other sensors typically used in the oilfield. The sensors can measure data at a periodic rate such as milliseconds, seconds, minutes, hours, days, and months. For example, the unit sensor module 144 can receive periodic data from a water level sensor 146. The managing application 136 within the control van 110 can establish unit level control of the water supply unit 112 by communicatively connecting to the unit control module 142 and the unit sensor module 144. The managing application 136 within the control van 110 can control the isolation valve 152 and water supply pump 148 via the unit control module 142. The control van 110 can monitor the equipment data, such as water level and flow rate, via unit sensor module 144. Although the water supply unit 112 is shown, all of the frac units can have a unit control module 142 and unit sensor module 144 such as the hydration blender 114, the chemical unit 116, the proppant storage unit 118, the mixing blender 120, the manifold 124, and the plurality of frac pumps 122. The managing application 136 within the control van 110 can direct the fracturing fleet, illustrated in FIG. 1, FIG. 2, FIG. 3, or FIG. 4, to prepare a fracturing fluid having a desired composition and pump the frac fluid at a desired pressure and flow rate, for example in accordance with a pumping schedule as described herein.

In an aspect, one or more frac units of the fracturing fleet, illustrated in FIG. 1, FIG. 2, FIG. 3, or FIG. 4, can be connected to the treatment well 130 at a production tree of the treatment well 130. For example, in FIG. 1, a wellhead isolation tool can connect the manifold 124 to the production tree. The wellhead isolation tool and production tree can include a unit sensor module (e.g., 144) with one or more surface sensors, downhole sensors, and associated monitoring equipment. The sensors on surface frac units can measure the equipment operating conditions including temperature, pressure, flow rate, density, viscosity, chemical, vibration, strain, accelerometers, exhaust, acoustic, fluid level, and equipment identity. Sensors on the wellhead isolation tool and production tree can measure the environment inside the treatment well including temperature, pressure, flow rate, density, viscosity, chemical, vibration, strain, accelerometers, and acoustic. In an aspect, one or more frac units of the frac fleet can connect to the treatment well 130 with a wellhead isolation tool, a wellhead, a production tree, a drilling tree, or a blowout preventer.

Figure 6:
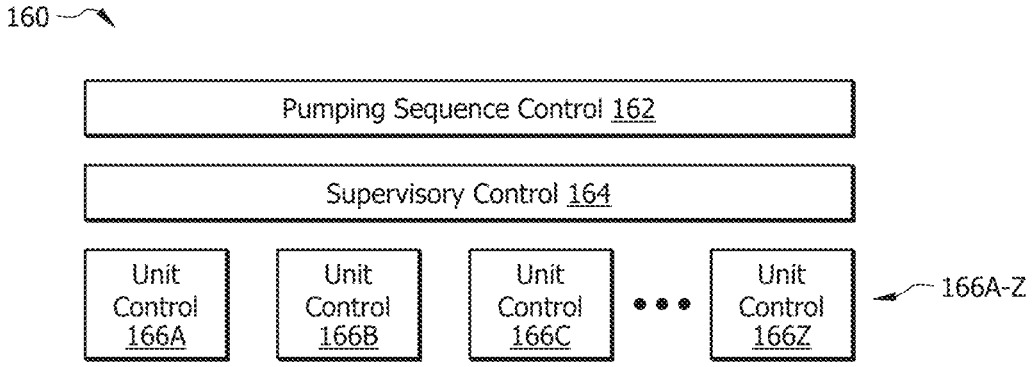
FIG. 6 is a block diagram of a hierarchy of a method of automated fleet control according to an embodiment of the disclosure.

The method used by the managing application 136 to pump the frac fluid at a desired pressure and flow rate can include an automated fleet control method following a pumping sequence. Turning now to FIG. 6, the hierarchy of a method of automated fleet control 160 is illustrated. The automated fleet control hierarchy 160 includes pumping sequence control 162, supervisory control 164, and a plurality of unit level control 166A-Z. The pumping sequence control 162 may be the managing application 136 executing on the computer 132. An operator located in the control van 110 may install a pumping sequence for a given fracturing service into the pumping sequence control 162 executing on the computer 132. The pumping sequence may be a series of steps, also called stages, defining one or more parameters of a fracturing job as a function of time or as a function of volume, wherein the parameters can include volumetric flow rate (e.g., barrels per minute) and pressure (e.g., pounds per square inch). A stage can be expressed by the time period required to pump a specific volume at a specified volumetric flow rate. The stage may also be expressed by the specific volume pumped during a time period by a specified volumetric flow rate. The volumetric flow rate can individually identify various components of the treatment volumetric flow rate, for example, water, clean flow rate (slick water), acid fluids, and dirty flow rate (proppant laden fluids). The addition of dry treatment additives, e.g., proppant, can be expressed as additive concentration (e.g., mass per unit volume such as pounds per gallon). The addition of liquid treatment additives, e.g., biocide, can be expressed as concentration units (e.g., gal of additive per 1000 gal of water). The pumping sequence can list one or more individual components and one or more combined components, for example, clean flow rate (e.g., slick water), proppant concentration (pounds per gallon), and dirty flow rate (e.g., proppant laden fluid). The pumping sequence can include stages with steady state flow rates and transition flow rates (ramp up flow rates and ramp down flow rates). The pumping sequence may include pressure as a limiting treatment value or as a target treatment value. When pressure is set as a limiting treatment value, the volumetric pump rate of the treatment may progress through a stage as long as the resulting pressure does not exceed the limiting treatment value. When pressure is set as a target treatment value, the volumetric pump rate of the treatment may deviate, e.g., increase or decrease, from an initial setting to achieve the target treatment value. Stages of a pumping sequence can correspond to various locations downhole, for example, fracturing a plurality of stages starting at the toe of a horizontal or lateral leg of a well and proceeding stage-wise to the heel of the lateral leg adjacent to a vertical portion of the wellbore. The pumping sequence control 162 (e.g., managing application 136) can direct the supervisory control 164 to follow the pumping sequence. The supervisory control 164 can direct the unit control 116A-Z to communicate the commands and instructions to the unit control module of each frac unit, such as unit control module 142 of the water supply unit 112. The supervisory control 164 may direct two or more frac units to work in concert with the same instructions given to each unit. For example, the supervisory control 164 can instruct the unit control 116A-Z to direct a plurality of frac pumps 122 to operate at the same pump rate. The supervisory control 164 can direct one or more frac units to operate within the same limits. For example, the supervisory control 164 can instruct the one or more unit controls 116A-Z to direct the mixing blender 120 to supply frac fluid to the plurality of frac pumps 122 at the same flow rate as the frac pumps 122 are pumping. Supervisory controller 164 can also instruct 120 to mix proppant, liquid additives, and/or dry additives at a particular rate and/or concentration.

Figure 7:
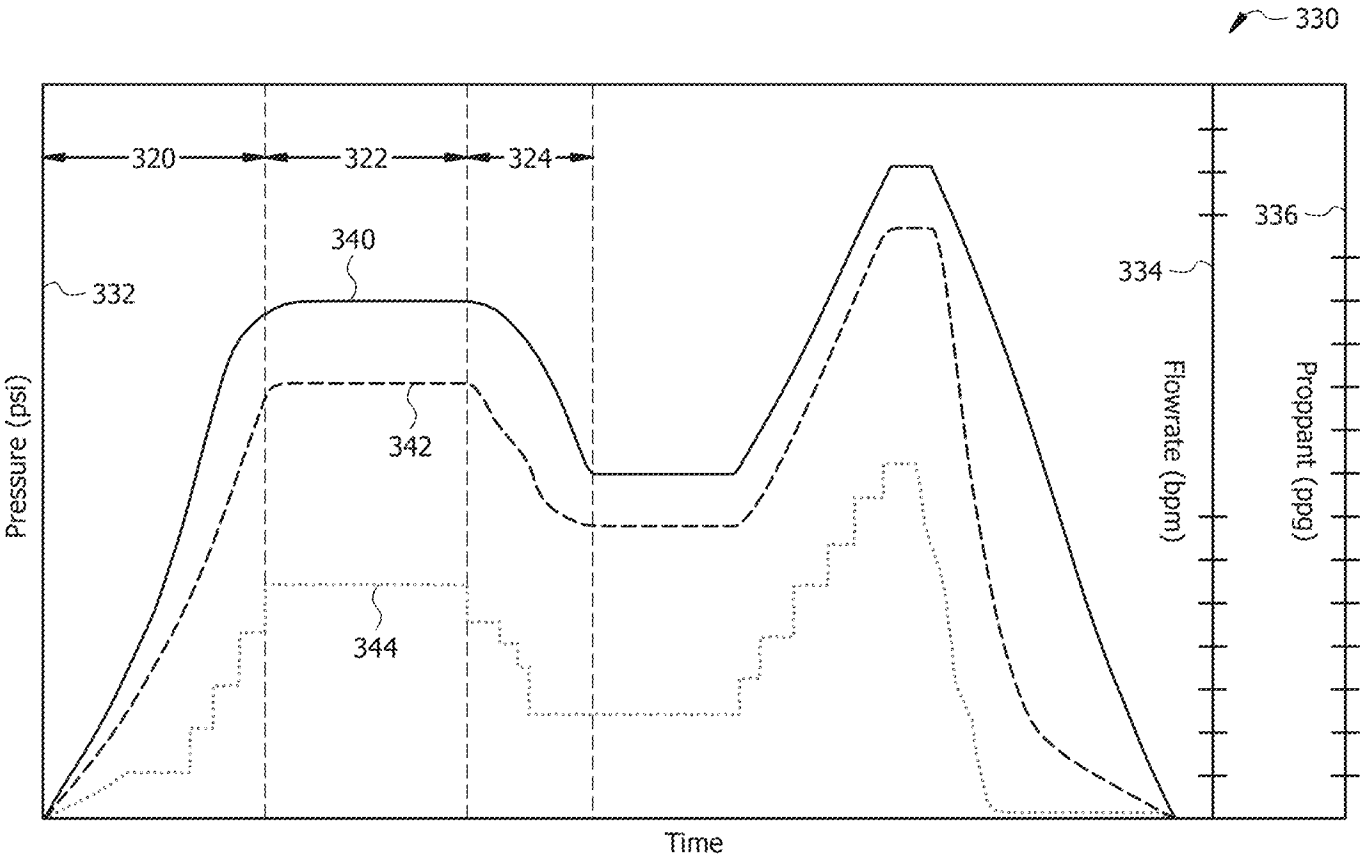
FIG. 7 is an illustration of a pumping sequence according to an embodiment of the disclosure.

A pumping sequence, also called a pumping schedule, may be comprised of a series of pumping stages with a transition between each pumping stage. For example, a pumping sequence may comprise a plurality of time-dependent pumping intervals, also called pumping stages, executed in a consecutive sequence (e.g., over a time period corresponding to a job timeline). The pumping stages may include steady-state stages and transition stages (e.g., having an increasing or decreasing parameter such as flow rate, proppant concentration, and/or pressure) that may be time dependent and represented as a function of time. Turning now to FIG. 7, a pumping sequence 330 is illustrated for a given treatment zone within a wellbore and comprises a plurality of stages 320, 322, 324, and 330. The pumping sequence is illustrated as a graph of fracturing job parameters such as pressure, flow rate, and proppant concentration (e.g., density) as a function of time. The chart includes a pressure axis 332 with units of pounds per square inch (psi), flowrate axis 334 with units of barrels per minute (bpm), a proppant concentration axis 336 with units of pounds per gallon (ppg), and a horizontal axis of time with units of seconds, minutes, or hours. The graph of the pumping sequence 330 includes a pressure plot line 340, flowrate plot line 342, and proppant plot line 344 for a single zone hydraulic fracturing treatment. The first stage 320 is a transition stage in the pumping sequence 330, where the pressure plot line 340, flowrate plot line 342, and proppant plot line 344 are increasing in value. The transition stages can be a smooth plotline (e.g., 340 and 342), indicating an approximate steady increase in pressure and flowrate or a stepped increase (e.g., 344) indicating an incremental increase in proppant density. The second stage 322 can be a steady state stage where the pumping rate remains steady (also referred to simply as a steady stage). The pressure plot line 340, flowrate plot line 342, and proppant plot line 344 are steady in value. The third stage 324 can be a transition stage where the plotlines are decreasing in value to another steady state stage. Although three pumping stages are described, in understood that the pumping schedule could have 3, 6, 12, 24, or any number of pumping stages. A fracturing job can include treatment for 2, 3, 4, 5, 10, 20, 40, 80, or any number of zones, and a corresponding number of pumping sequences 330 of the type illustrated in FIG. 7 can be used, and collectively a plurality of pumping sequences corresponding to a plurality of treatment zones (e.g., fracturing zones) within a wellbore may be referred to collectively as an overall well treatment/fracturing schedule for a given well. The pumping sequence 330 can include the pumping operations of multiple groups of pumping equipment, such as the clean fluid group 260 and the dirty fluid group 250 shown in FIG. 2 or FIG. 3, within each stage or zone treated as will be described herein. In embodiments, one or more stages can be a combination of steady and transition stages, where some parameters change while others do not. For example, the pump rate to each well can remain constant while the proppant concentration is stepped or ramped up during the stage.

Figure 8:
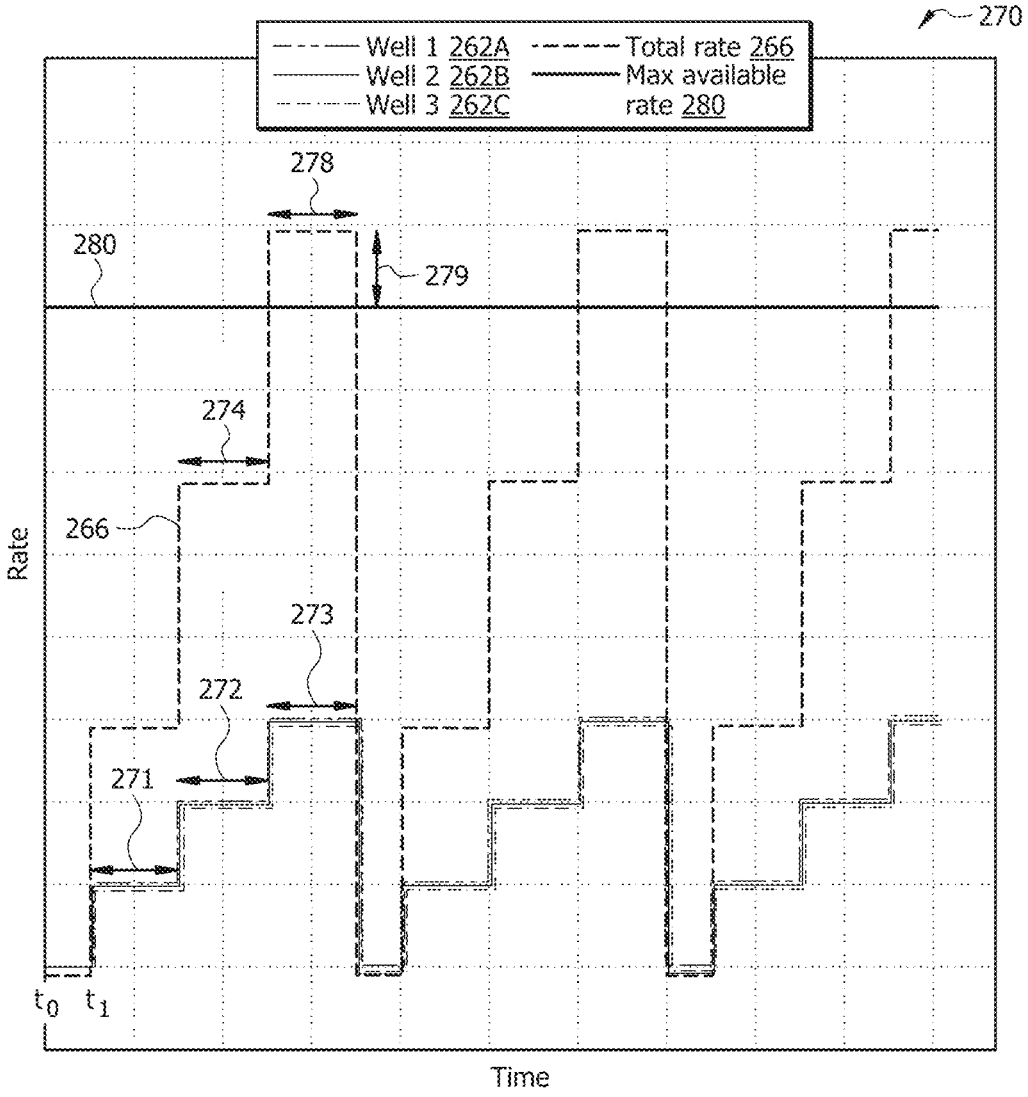
FIG. 8 is an illustration of a combined pumping sequence according to an embodiment of the disclosure.

A pumping schedule to simultaneously treat three or more wells can be created based on pumping equipment availability. Turning now to FIG. 8 with reference to FIG. 2, a combined pumping schedule, or combined pumping sequence 270 (also referred to herein as a "multi-well treatment schedule" or "combined treatment schedule"), is illustrated for a given treatment zone within a wellbore. As detailed hereinbelow, the treatment schedule depicted in FIG. 8 exceeds a maximum available rate 280, for example during interval 278. The chart in FIG. 8 may represent a combined pumping sequence with a pumping schedule for flow rate of proppant slurry delivered to the first wellbore 230A, a pumping schedule for the second wellbore 230B, and a pumping schedule for the third wellbore 230C, e.g., as shown in FIG. 2. The graph of the combined pumping sequence 270 includes a flowrate plot line 262A for a pumping sequence for the first wellbore 230A, a flowrate plot line 262B for a pumping sequence for the second wellbore 230B, a flowrate plot line 262C for a pumping sequence for the third wellbore 230C, and a total flowrate plot line 266 for the combined pumping sequence. The combined pumping sequence 270 and total flowrate 266 represents the summation of the flowrate 262A for the first wellbore 230A plus flowrate 262B for the second wellbore 230B plus the flowrate 262C for the third wellbore 230C. The combined pumping sequence 270 may have any number of stages, also called intervals. For example, pumping stage 274, also called interval 274, is a steady stage over an interval of time, that coincides with interval 272 for flowrates 262A, 262B, and 262C, where the flowrates (262A, 262B, and 262C) do not change. Interval 278 is a steady stage over an interval of time, that coincides with interval 273 for flowrate 262A, 262B, and 262C, where the flowrates (262A, 262B, and 262C) do not change. However, during interval 278, the total flowrate 266 exceeds, by a value 279, the maximum available rate 280 (which is an operating limit of the fracturing units). The total flowrate 266 and the operating limit, e.g., 280, may depend on the type of fracturing unit. For example, the operating limit of the water supply unit 112 may be the total flowrate of water. The operating limit for the chemical unit 116 may be the total flowrate of chemicals. The operating limit of the blender may be the total flowrate exiting the blender, the flowrate capacity of the supply lines to the blender, the flowrate capacity of the proppant supply, the maximum proppant metering of the blender, or the blender may be limited by the total volume of the blend tub. The operational limit of the proppant storage unit 118 may be the total flowrate of proppant. The operational limit of the frac pump 122 may be a combination of pressure limit and total flowrate. The operational limit of the high pressure line 222, wellhead, and associated wellhead isolation equipment may be a combination of pressure limit and total flowrate. The combined pumping sequence 270 may be modified during the design phase to reduce the total flowrate 266 below the maximum available rate 280 during interval 278. Although the pumping sequence 270 represents the flowrate delivered to the first wellbore 230A, the second wellbore 230B, and third wellbore 230C, it is understood that the combined pumping sequence 270 could represent four, five, or any number of wells. Although the combined pumping sequence 270 illustrates the total flowrate 266 and maximum available flowrate 280, it is understood that the chart could present water flowrate, proppant flowrate, gelled fluid flowrate, proppant slurry flowrate, pump flowrate, chemical flowrate, blender tub level, or any other operational limit.

Figure 9:
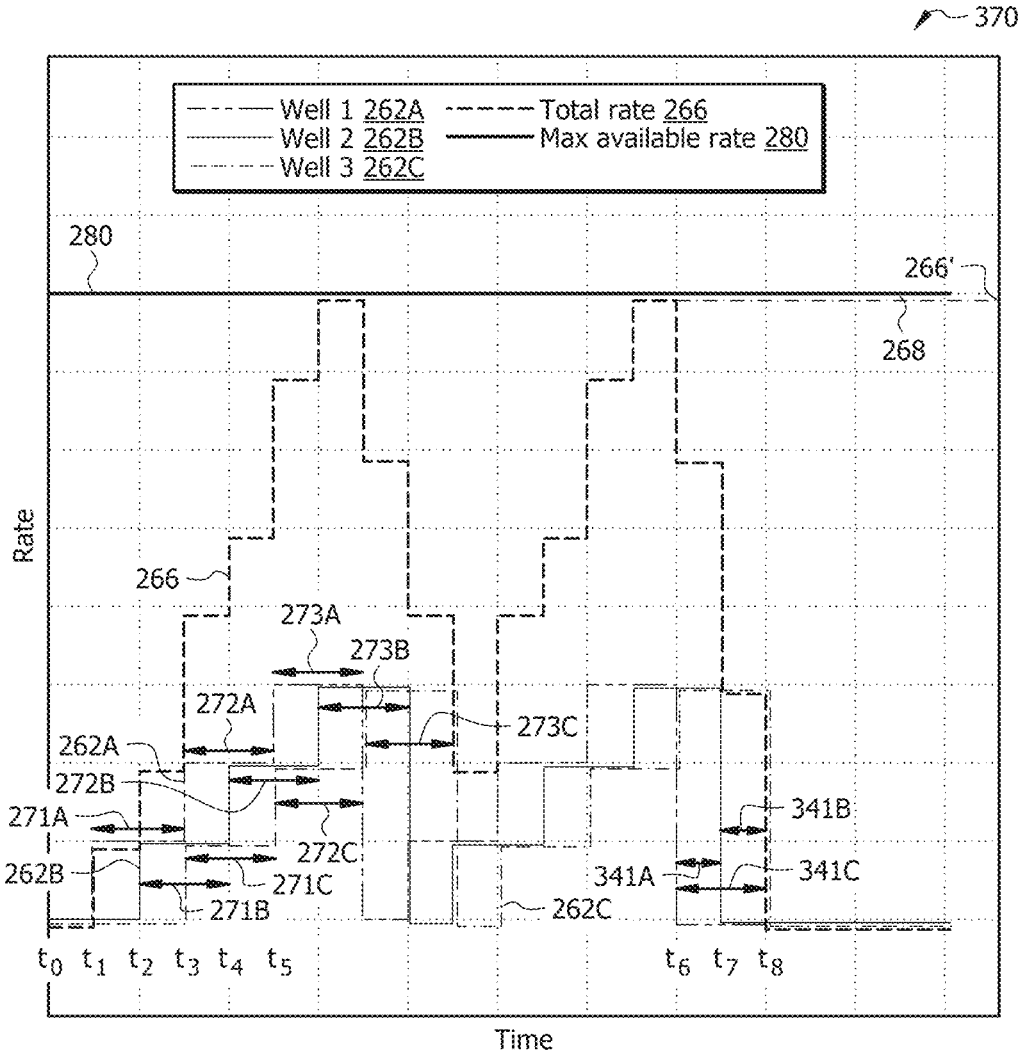
FIG. 9 is an illustration of a modified combined pumping sequence according to an embodiment of the disclosure.

In embodiments, the plot lines and stage plans include concentration values instead of rate values such as depicted in FIG. 7, FIG. 8, and FIG. 9) for certain parameters. For example, the stage plan can, in embodiments, include concentration values for proppant and/or liquid chemicals such as friction reducer. In such embodiments, the pumping sequence control, supervisory control or unit control can be a concentration value and not a rate. The pumping sequence control can convert the concentration to a rate and verify that the maximum allowable rate is not exceeded.

In embodiments, optimum staggered start times for treatment of each of the multiple wells is calculated/determined. The optimum stagger times can be selected to ensure a treatment rate variable does not exceed a preselected maximum operating limit. This preselected operating limit may be the ultimate maximum capability of the fracturing unit, as described hereinbelow with reference to the embodiment of FIG. 9, or some lower limit than the ultimate maximum capability, as described hereinbelow with reference to FIG. 10. Setting an operating limit lower than the maximum rate can reserve available capacity for use if needed for adjustment to the treatment schedule for one or more of the multiple wells (e.g., and thus the combined treatment schedule) on-the-fly, as it can sometimes be required to adjust the treatment schedule on-the-fly based on the response of the wells to the treatment.

By way of example, a modified combined pumping schedule (also referred to as a modified pumping sequence) to simultaneously treat three or more wells can be modified based on the available pumping equipment operational limits. Turning now to FIG. 9 with reference to FIG. 2, a modified combined pumping schedule, or modified combined pumping sequence 370, is illustrated. As detailed further hereinbelow, the modified treatment schedule 370 of FIG. 9 utilizes staggered (or "offset") start times for the treatments to the three wellbores to maintain the total flow rate 266 below the maximum available flow rate 280. The chart in FIG. 9 may represent the flow rate of proppant slurry delivered to the first wellbore 230A, the second wellbore 230B, and the third wellbore 230C shown in FIG. 2. The graph of the modified combined pumping sequence 370) includes a flowrate plot line 262A for the pumping sequence for the first wellbore 230A, a flowrate plot line 262B for the pumping sequence for the second wellbore 230B, a flowrate plot line 262C for the pumping sequence for the third wellbore 230C, and a total flowrate plot line 266 for the combined pumping sequence 370. The total flowrate 266 represents the summation of the flowrate 262A for the first wellbore 230A plus flowrate 262B for the second wellbore 230B plus flowrate 262C for the third wellbore 230C. The combined pumping sequence 370 may have any number of stages or timed intervals. The pumping sequence for the first wellbore 230A may begin before the pumping sequence for the second wellbore 230B and/or the third wellbore 230C. In embodiments, the pumping sequence for the second wellbore 230B may begin before the pumping sequence for the third wellbore 230C. The first pumping stage, or time interval, for the first wellbore 230A (and optionally every subsequent pumping stage) may begin before the first pumping stage (and optionally every subsequent pumping stage) for the second wellbore 230B and/or the third wellbore 230C. The first pumping stage, or time interval, for the second wellbore 230B (and optionally every subsequent pumping stage) may begin before the first pumping stage for the third wellbore 230C. Said another way, the first pumping stage for the second wellbore 230B, flowrate 262B, may begin at the end of the first pumping stage for the first well, flowrate 262A, and/or the first pumping stage for the third wellbore 230C, flowrate 262C, may begin at the end of the first pumping stage for the second well, flowrate 262B.

For example, pumping stage 271A is a steady stage over an interval of time (e.g., from t1 to t3) for the flowrate 262A of the first well 230A. The pumping stage 271B is a steady stage over an interval of time (e.g., from t2 to t4) for the flowrate 262B of the second wellbore 230B that is identical in time interval and rate to pumping stage 271A for the flowrate 262A of the first well 230A. Similarly, the pumping stage 271C is a steady stage over an interval of time (e.g., from t3 to t5) for the flowrate 262C of the third wellbore 230C that is identical in time interval and rate to pumping stage 271A for the flowrate 262A of the first well 230A and pumping stage 271B for the flowrate 262B of the second well 230B. Pumping stage 271B begins (e.g., at t2) before pumping stage 271A ends (e.g., at t3); pumping stage 271C begins (e.g., at t3) before pumping stage 271B ends (e.g., at t4). The pumping sequence for the first well, flowrate 262A, includes pumping stage 271A, 272A, and 273A. The pumping sequence for the second well, flowrate 262B, includes corresponding pumping stage 271B, 272B, and 273B that are offset in time from the first well flowrate 262A. The pumping sequence for the third well, flowrate 262C, includes corresponding pumping stage 271C, 272C, and 273C that are offset in time from the first well flowrate 262A and the second well flowrate 262B.

The total flowrate 266 can be below the maximum available rate 280 by a minimum value 268. The minimum value can be maintained greater than or equal to zero, such that the total flowrate 266 can be equal to or below the maximum rate 280 for the entire pumping schedule. Delaying the start of the pumping sequence for the second well 230B (e.g., by a time t2-t1) and/or the third well 230C (e.g., by a time t3-t1) relative to the start of the pumping sequence for the first wellbore 230A, and/or delaying the start of the pumping sequence for the third wellbore 230C (e.g., by a time t3-t2) relative to the second wellbore 230B can be utilized to decrease the total flowrate 266 below the maximum rate 280, for example as shown by reference numeral 268. Although the pumping sequence 370 illustrates the flowrate and maximum available rate 280, it should be understood that the chart could present water flowrate, proppant flowrate, gelled fluid flowrate, proppant slurry flowrate, pump flowrate, chemical flowrate, blender tub level, or any other operational limit.

As described hereinabove with reference to FIG. 9, the multi-well modified treatment schedule 370 can be designed, pre-planned, and/or adjusted "on the fly" (e.g., during the simultaneous treatment of the multiple wellbores) so the maximum of the parameter (e.g., total flow rate 266) does not to exceed the maximum operating limit (e.g., a maximum available rate 280).

As noted hereinabove, in embodiments, the multi-well modified treatment schedule 370 can be designed, pre-planned, and/or adjusted "on the fly" (e.g., during the simultaneous treatment of the multiple wellbores) so the maximum of the parameter (e.g., total flow rate 266) does not exceed a target operating limit (e.g., target maximum total flow rate 280A) that is less than the maximum operating limit (e.g., a maximum available rate 280 capability of the fracturing unit). As discussed in detail hereinbelow with reference to FIG. 10, the minimum value 268 can be increased to provide an additional available capacity or buffer 268 for adjustment to the treatment schedule on-the-fly, as desired.

In embodiments, as further described hereinbelow with reference to FIG. 10, the multi-well modified treatment schedule 370 can be designed to minimize the required operating parameter (e.g., total flow rate) instead of solely optimizing to stay below a maximum (e.g., maximum available total flow rate 280) of the fracturing unit. For example, such embodiments, the offset between starting time of the first, second, and third (or more) well treatments can be selected to maximize the time the forklift has for exchanging containers on the proppant equipment 118 across the full time range of the multi-well treatment.

In the embodiment of FIG. 9, described hereinabove, the second pumping sequence is staggered (e.g., delayed) relative to the first pumping sequence, and the third pumping sequence is staggered (e.g., delayed) relative to the second pumping sequence (and thus also the first pumping sequence). In the modified pumping sequence of FIG. 9, the second pumping sequence begins (e.g., at t2) prior to the end of the first steady stage 271A of the first pumping sequence (e.g., at t3), and the third pumping sequence begins (e.g., at t3) prior to the end of the first steady stage 271B of the second pumping sequence (e.g., at t4). Reference will now be made to FIG. 10, which is an illustration of another modified combined pumping sequence 370 according to an embodiment of the disclosure. As detailed further hereinbelow, FIG. 10 depicts an embodiment in which the modified combined pumping schedule provides a leveled maximum rate 266 and a substantial buffer 268. In the embodiment of FIG. 10, the entire first steady stage 271A of the first pumping sequence is completed prior to the start of the first steady stage 271B of the second pumping sequence, and the entire first steady stage 271B of the second pumping sequence is completed prior to the start of the first steady stage 271C of the third pumping sequence, and so on for more than three wellbores. In this embodiment, first steady stage 271A of the first pumping sequence ends (e.g., at time t2) when the first steady stage 271B of second sequence begins (e.g., at t2), and first steady stage 271B of the second pumping sequence ends (e.g., at time t3) when the first steady stage 271C of third sequence begins (e.g., at t3). The modified pumping sequence can be an optimized modified pumping sequence for which the total flow rate 266 is less than target operating limit 280A, which target operating limit 280A is less than the maximum available rate 280 by buffer 268. The maximum of the total flow rate 266 of the modified pumping sequence is significantly less than the max available rate 280, by the difference 268', where 268'≥268. The modified pumping sequence 370 can be designed such that difference 268' between the maximum of the total flow rate 266 of the modified pumping sequence at least 10, 20, 30, or 40% less than the max available rate 280, (i.e., that 268' is greater than or equal to 10, 20, 30, or 40% of the maximum available rate 280). The modified pumping sequence 370 can be designed such that difference 268 between the target maximum 280A of the total flow rate 266 of the modified pumping sequence at least 10, 20, 30, or 40% less than the max available rate 280, (i.e., that 268 is greater than or equal to 10, 20, 30, or 40% of the maximum available rate 280), thus providing an additional buffer capacity (e.g., additional flow rate capacity above an expected target maximum total flow rate).

In embodiments, the levelling provided by the modified combined pumping sequence can reduce the variability of an operating parameter by 5, 10, 15, 20, 25% or more, regardless of whether or not the initially combined pumping sequence exceeded an operating limit for that (or another) operating parameter.

Figure 10:
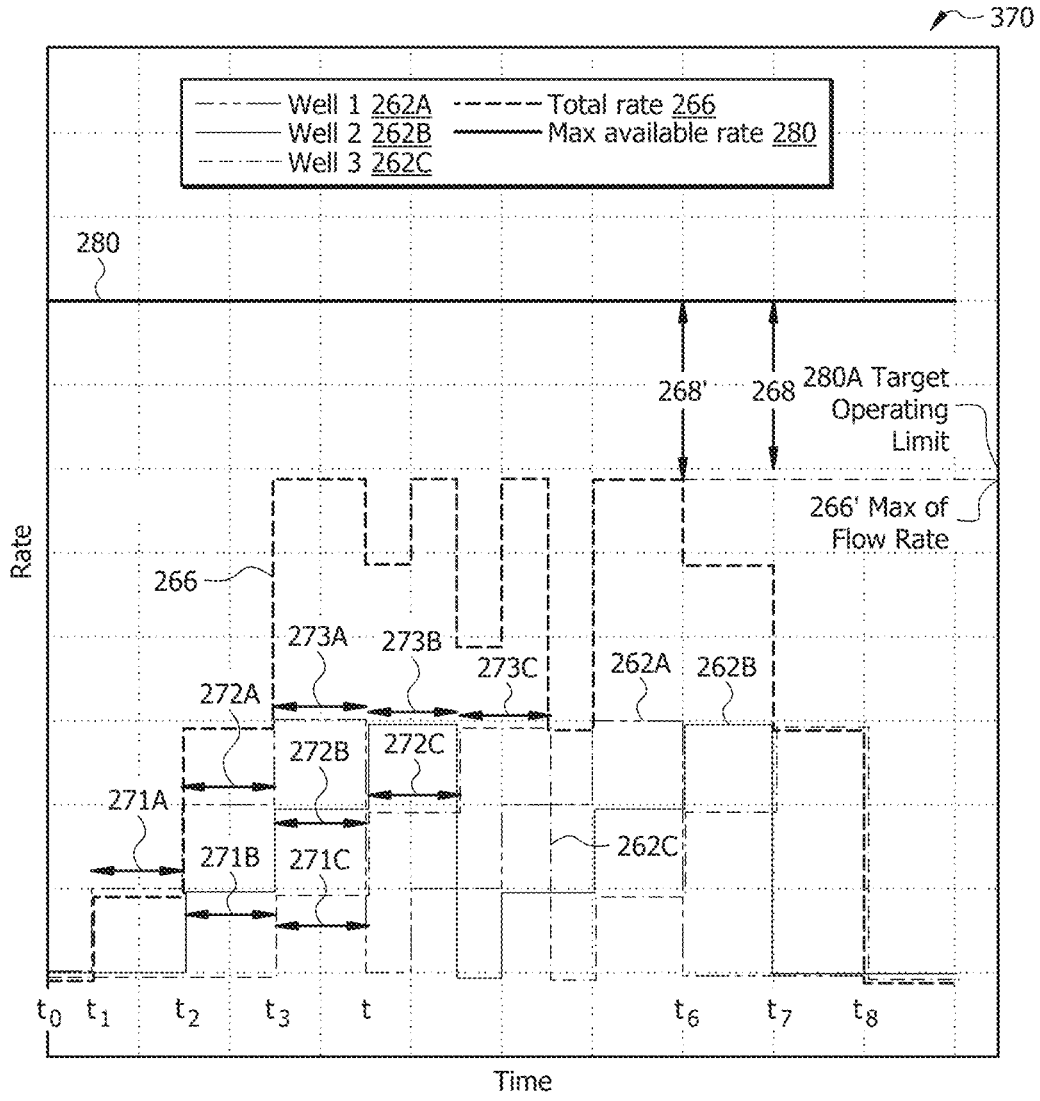
FIG. 10 is an illustration of another modified combined pumping sequence according to an embodiment of the disclosure.

Thus, the leveled and staggered modified pumping sequence 370 of FIG. 10 can provide a buffer 268 relative to the staggered modified pumping sequence 370 of FIG. 9. The leveled modified combined pumping sequence 370 can facilitate the operations. The leveled modified pumping sequence 370 of FIG. 10 also provides more level total flow rate 266 relative to the modified pumping sequence 370 of FIG. 9, which can facilitate operating during the simultaneous wellbore treatments. For example, leveling the modified pumping sequence 370, as described with reference to FIG. 10 can provide for more consistent operation of a forklift, conveyor belt, front end loader, container flipper or rotator for proppant material (e.g., wet sand, dry sand, other proppant), and/or the mixing capacity of the blender tub.

The modified treatment schedule 370 can be designed, for example, to operate a fracturing unit as close to a steady rate as possible, as shown for total flow rate in FIG. 10. For example the stagger or offset time for the treatment schedule (e.g., the difference or offset t2-t1 from the start of the first pumping sequence to wellbore 230A and second pumping sequence to wellbore 230B, the difference or offset t3-t1 from the start of the first pumping sequence to wellbore 230A and third pumping sequence to wellbore 230C, and/or the difference or offset t3-t2 from the start of the second pumping sequence to wellbore 230A and third pumping sequence to wellbore 230C), could be set to operate the (e.g., proppant) equipment at as constant a rate as possible throughout the full day. Such optimization can be utilized to reduce or minimize the required operating rate, rather than optimizing to stay below a maximum rate threshold (as described with reference to FIG. 9). In this manner, the time the forklift has for exchanging containers could be leveled (e.g., made more consistent) to remove both the very long and very short times between container changes. The planning of the optimum start time for the treatment of each well can be calculated using the supervisory control software (e.g., the supervisory control 164, as described herein) controlling the equipment performing the frac treatment.

When the first treatment stage is completed on a well, it is typically quickly followed up with a treatment of the next stage of the well. Transition times from the end of one treatment stage to the start of the next treatment stage can be on the order of ten to thirty minutes or more. It may be beneficial to take into consideration multiple treatment stages when planning the optimum stagger sequence for the start times of the various stages of the various wells. In other words, in embodiments, a better optimum may be attained by considering all treatments planned to be completed in a day as opposed to optimizing on a stage by stage basis. That is, the analysis to determine the modified treatment schedule can consider one or more (e.g., all) stages of each of the wells being treated simultaneously to optimally stagger and/or level the modified combined treatment schedule.

In embodiments, an optimum stagger for start times is determined and then additional time (e.g., additional transition time) can be added to the stagger to provide a buffer time that can be available if a treatment stage needs to be extended based on an on-the-fly decision made during the simultaneous treatment of the multiple wells. Another method to increase the rate on-the-fly during the treatment to one well can be to reduce the rate to one or more of the other wells being treated simultaneously with the one well. The allowable reduction amount per well and the priority of which one or more wells would have the rate reduced can be pre-planned in the supervisory control software controlling the equipment performing the frac treatment. Thus, in embodiments, the rate of a treatment parameter to one or more wells being simultaneously treated can be reduced during the treatment when it is determined that the treatment parameter needs to be increased on another one of the multiple wells, while still remaining below the maximum operating limit 280 (e.g., of the blender). The reduction amount can be equally or unequally shared by the other wells being simultaneously treated. How the reductions are shared among the wells can be pre-planned into the pumping sequence control software prior to the start of the job. If a buffer 268 has been pre-programmed, the treatment parameter can be increased on one or more of the multiple wells, without reducing the rate of a treatment parameter to one or more other wells being simultaneously treated, as long as the increase does not surpass the maximum available limit (e.g., so long as the maximum available rate 280 is not surpassed), although the target operating parameter (e.g., the target maximum rate 280A) may be (e.g., temporarily) surpassed.

In FIG. 8, FIG. 9, and FIG. 10, the rate changes for the treatment are shown as stepping from one rate to the next and always increasing as the treatment progresses. However, as will be apparent to those of skill in the art, it is to be understood that, in some cases the rate changes for each pumping sequence can be made in a ramp fashion, and/or that in embodiments the rate may either step or ramp to a lower rate instead of a higher rate. Although three wells are depicted in the embodiments of FIG. 8, FIG. 9, and FIG. 10, more than three wells can be simultaneously treated according to the system and method of this disclosure.

A modified pumping sequence 370 for three or more wellbores may be developed for the fracturing equipment using a single blender, for example as illustrated in FIG. 2. In an embodiment, the managing application 136 may identify a pumping interval of a combined pumping sequence that exceeds an operational limit of the fracturing equipment during creation of the combined pumping schedule of three or more wellbores.

Returning to FIG. 2, a hydraulic fracturing fleet, e.g., hydraulic fracturing system 170 comprising a plurality of individual fracturing equipment (also referred to as fracturing equipment units or fracturing units), can be configured to pump hydraulic fracturing fluids into three or more wellbores. A first wellbore 230A can receive hydraulic fracturing fluids from a first manifold fluidly connected to a first set of frac pumps 122. A second wellbore 230B can receive hydraulic fracturing fluids from a second manifold fluidly connected to a second set of frac pumps 122. A third wellbore 230C can receive hydraulic fracturing fluids from a second manifold fluidly connected to a second set of frac pumps 122. The first manifold 204A, second manifold 204B, and third manifold 204C are fluidly connected to blending unit 219/blender(s) 202. The fracturing fluid produced by the blender 202 from a water supply 112A, a chemical unit 116A, and a proppant storage unit 118 can be delivered to the first manifold 204A via a feed line 208A, to the second manifold 204B via a feed line 208B, and to the third manifold 204C via a feed line 208C. The managing application 136, executing on a computer system 132, can control the fracturing units via a corresponding plurality of unit control modules, for example Unit Control modules 166 in FIG. 6.

A first pumping sequence for a first wellbore, e.g., 230A, may be loaded into the managing application 136. The pumping sequence, i.e., pumping sequence 330, may comprise multiple sequential intervals as illustrated in FIG. 7. The pumping sequence may include pressure, flow rate, and proppant density targets based on customer criteria, fracture propagation modeling, prior field results, or a combination thereof.

A second pumping sequence for a second wellbore, e.g., 230B, may be loaded into the managing application 136. The pumping sequence, i.e., pumping sequence 330, may comprise multiple sequential intervals as illustrated in FIG. 7. The pumping sequence may include pressure, flow rate, and proppant density targets based on customer criteria, fracture propagation modeling, prior field results, or a combination thereof. The second pumping sequence may have the same intervals as the first pumping sequence. Alternatively, the second pumping sequence may have different intervals than the first pumping sequence. In an embodiment, the first pumping sequence for wellbore 230A and the second pumping sequence for wellbore 230B are the same.

A third pumping sequence for a third wellbore, e.g., 230C, may be loaded into the managing application 136. The pumping sequence, i.e., pumping sequence 330, may comprise multiple sequential intervals as illustrated in FIG. 7. The pumping sequence may include pressure, flow rate, and proppant density targets based on customer criteria, fracture propagation modeling, prior field results, or a combination thereof. The third pumping sequence may have the same intervals as the first pumping sequence and/or the second pumping sequence. Alternatively, the third pumping sequence may have different intervals than the first pumping sequence and/or the second pumping sequence. In embodiments, the first pumping sequence for the first wellbore 230A, the second pumping sequence for the second wellbore 230B, and/or the third pumping sequence for the third wellbore 230C can be the same. In embodiments, the first pumping sequence for the first wellbore 230A, the second pumping sequence for the second wellbore 230B, and/or the third pumping sequence for the third wellbore 230C can be different.

A combined pumping sequence, e.g., 270 as illustrated in FIG. 8, can be produced by the managing application 136. The first pumping sequence for a first wellbore 230A may comprise a plurality of intervals with a start time and an end time for each interval corresponding to a timeline. The second pumping sequence for a second wellbore 230B may comprise a plurality of intervals with a start time and an end time for each interval corresponding to a timeline. The third pumping sequence for a third wellbore 230C may comprise a plurality of intervals with a start time and an end time for each interval corresponding to a timeline. The managing application 136 may designate the start time of the first interval as the launch time of each pumping sequence. The managing application 136 may overlay the second pumping sequence and the third pumping sequence onto the first pumping sequence by coinciding the launch time of each pumping sequence as the launch time of the combined pumping sequence. The managing application 136 may sum the values for the first interval of the first pumping sequence with the values for the first interval of the second pumping sequence and the third pumping sequence (and so on for more than three wellbores 230) to produce the values for the combined pumping sequence. The managing application 136 may continue summing the values for each interval of the first pumping sequence, the second pumping sequence, and the third pumping sequence (and so on for more than three wellbores) to produce the combined pumping sequence. The managing application 136 can compare the summation of each interval to a threshold for each fracturing unit, e.g., max available rate 280 in FIG. 8.

Alternatively, the managing application 138 may overlay each interval of the first pumping sequence, e.g., 262A, with the second pumping sequence, e.g., 262B, to synchronize with the start of a steady-state interval and therefore allow the transition intervals to lag one another. For example, in embodiments, the managing application 138 may flex, delay, or offset the start of a steady state interval for the first pumping sequence and the second pumping sequence until the pressures in the first wellbore 230A and the second wellbore 230B reach the target value. Similarly, the managing application 138 may flex, delay, or offset the start of a steady state interval for the second pumping sequence and the third pumping sequence until the pressures in the second wellbore 230B and the third wellbore 230C reach the target value. In embodiments, the managing application 138 may coincide the start of a transition interval with the flowrates increasing for the first pumping sequence and the second pumping sequence and/or the third pumping sequence. Similarly, the managing application 138 may coincide the start of a transition interval with the flowrates increasing for the second pumping sequence and the third pumping sequence, and so on for more than three wellbores. A combined pumping sequence can show the total flow rate from one or more fracturing units, for example, the water supply 112A, the chemical unit 116A, the proppant storage unit 118, or the blender 202.

The managing application 136 may identify one or more intervals where the combined flowrate exceeds an operational limit of one or more of the fracturing units. For example, in FIG. 8, the total flowrate 266 exceeds the maximum available rate 280 in interval 278 by value 279. In another example, turning back to FIG. 2, the total flowrate 266 may be the flowrate of proppant from the proppant storage unit 118 to the blender 202. In still another example, the total flowrate 266 may be the flowrate of fracturing treatment from the blender 202 to the first manifold 204A, the second manifold 204B, and the third manifold 204C.

The managing application 136 may offset the pumping sequence for the second wellbore 230B and/or the third wellbore 230C from the pumping sequence for the first wellbore 230A, and/or may offset the pumping sequence for the third wellbore 230C from the pumping sequence for the second wellbore 230B to lower the combined output, e.g., flowrate. As illustrated in FIG. 9 and FIG. 10, the managing application 136 may offset the pumping sequence for the second wellbore 230B by delaying the start of the first steady interval 271B for a period of time (e.g., an offset period of time equal to or greater than the period of time for which the interval wherein a parameter of the fracturing job (e.g., flow rate, pressure, etc.) exceeds an operational limit/threshold of one or more fracturing units/equipment). The modified pumping sequence consists of first pumping sequence, e.g., flowrate 262A, with a first start time and a second pumping sequence, e.g., flowrate 262B, with a start time delayed for a period of time. In the example shown in FIG. 9 and FIG. 10, the entire pumping sequence for the second wellbore 230B is offset by the start time delay, thereby lowering the combined output below an operational limit of the fracturing equipment. In embodiments, only a fraction (e.g., one or more intervals) of the entire pumping sequence for one or more of the wellbores needs to be offset to lower the combined output of that fraction of the entire pumping sequence (e.g., those one or more intervals), such that the entire pumping sequence remains below an operational limit of the fracturing equipment.

In an embodiment where at least a portion of the first, second, and third pumping sequences are carried out simultaneously, a portion of the pumping sequence for the second wellbore 230B may be offset from the pumping sequence for the first wellbore 230A to avoid exceeding an operational limit of one or more of the fracturing units regardless of whether the start times for the first and second pumping sequences are the same or different. Similarly, a portion of the pumping sequence for the third wellbore 230C may be offset from the pumping sequence for the first wellbore 230A and/or the second wellbore 230B to avoid exceeding an operational limit of one or more of the fracturing units regardless of whether the start times for the second and third pumping sequences are the same or different. For example, the pumping sequence for the first wellbore 230A and the pumping sequence for the second wellbore 230B and/or the pumping sequence for the third wellbore 230C may overlay and begin at the same time as shown in FIG. 8. The combined pumping sequence may have a portion of the intervals coincide until interval 274 of FIG. 8. The managing application 136 may offset intervals 273A, 273B, and 273C of FIG. 8 to lower the combined output (e.g., the combined modified pumping sequence). The managing application 136 may extend the pumping of an interval of the pumping sequence for the second wellbore 230B and/or the third wellbore 230C (and so on for more than three wellbores) to offset the pumping sequence from the pumping sequence of the first wellbore 230A, and/or the managing application 136 may extend the pumping of an interval of the pumping sequence for the third wellbore 230C (and so on for more than three wellbores) to offset the pumping sequence from the pumping sequence of the second wellbore 230B to offset the pumping sequence from the pumping sequence of the second wellbore 230A. The managing application 136 may continue the flowrate at the same rate during the extended interval or may change, i.e., decrease the flowrate during the extended interval. In an aspect, the managing application 136 may pause pumping sequence for the second wellbore and/or the third wellbore while continuing the pumping sequence of the first wellbore, and then conversely pause the pumping sequence of the first wellbore while resuming the pumping sequence of the second wellbore and/or the third wellbore until the interval in which the combined pumping sequence exceeds an operational limit of one or more fracturing units/equipment. Upon applying the offset to traverse the potentially problematic interval (e.g., where an operational limit of equipment may be exceeded), the managing application can resume the three pumping sequences in tandem for the remainder of the job provided that there are no further intervals requiring an offset to avoid potential equipment operational limits.

In an embodiment, a portion of the pumping sequence for the second wellbore 230B and/or the third wellbore 230C (and so on for more than three wellbores) may be offset from the pumping sequence for the first wellbore 230A due to notification of a change in the pumping operation. Sensors on the equipment may notify the service personnel that the wellbore response has changed causing an operation value to exceed a predetermined threshold. For example, in a first scenario, the pressure within the second wellbore 230B and/or the third wellbore 230C may decrease below a threshold value indicating that that volume of proppant entering the formation may need to be increased. The managing application 136 may increase the current interval for the second wellbore 230B and/or the third wellbore 230C while continuing the pumping schedule for the first wellbore 230A. The increase in the interval may offset the second pumping procedure from the first pumping procedure to create a modified combined pumping sequence. In a second scenario, the pressure within the first wellbore 230A may increase above a threshold indicating that proppant is no longer entering the formation. The managing application 136 may decrease the current interval for the first wellbore 230A to step to the next interval of the pumping sequence while continuing the pumping sequence for the second wellbore 230B and/or the third wellbore 230C. The decrease in the current interval for the pumping sequence for the first wellbore 230A may offset the pumping sequence for the first wellbore 230A with the pumping sequence for the second wellbore 230B and/or the third wellbore 230C to create a modified combined pumping sequence. In executing the first or second scenario where the expected fracturing job is modified "on-the-fly" in response to a change encountered while performing the fracturing job, the managing application 136 may modify the combined pumping routine or the modified combined pumping routine in response to notification of an operational value, e.g., pressure, temperature, or flowrate, exceeds a predetermined value or range to include one or more offsets of the type described herein to avoid exceeding an operation limit of one or more fracturing units/equipment.

A modified combined pumping sequence 370 to pump a fluid treatment into three or more wellbores may be developed to utilize a variety of fracturing equipment. The available fracturing equipment may comprise frac units of different models and types. In an embodiment, the managing application 136 may assign fracturing equipment to a modified pumping sequence 370 based on a variety of operational characteristics, for example based upon the blender type.

Returning to FIG. 3, for example, a hydraulic fracturing fleet, e.g., hydraulic fracturing system 200, can be configured to pump hydraulic fracturing fluids into three wellbores. A first wellbore 230A can receive hydraulic fracturing fluids from a first manifold 204A fluidly connected to a first set of frac pumps 122. A second wellbore 230B can receive hydraulic fracturing fluids from a second manifold 204B fluidly connected to a second set of frac pumps 122. The first manifold 204 and second manifold 206 are fluidly connected to blender 202. A third wellbore 230C can receive hydraulic fracturing fluids from a third manifold 204C fluidly connected to a third set of frac pumps 122. The fracturing fluid produced by the blending unit 219A from blender(s) 202 and associated water supply 112A, chemical unit 116A, and proppant storage unit 118 can be delivered to the first manifold 204A via a feed line 208A, to the second manifold 204B via a feed line 208B, and to the third manifold 204C via a feed line 208C. The managing application 136, executing on a computer system 132, can assign a plurality of fracturing units to a first fluid group 250 of fracturing units that will pump proppant laden (e.g., dirty) fluids to the first wellbore 230A, the second wellbore 230B, and the third wellbore 230C via the first dirty manifold 204A, the second dirty manifold 204B, and the third dirty manifold 204C, respectively.

The managing application 136, executing on a computer system 132, can assign a plurality of fracturing units to a second fluid group 260 of fracturing units that will pump gelled (e.g., clean) fluids to the first wellbore 230A, the second wellbore 230B, and the third wellbore 230C via the fourth (e.g., clean) manifold 214A, the fifth (e.g., clean) manifold 214B, and the sixth (e.g., clean) manifold 214C, respectively. A first wellbore 230A can receive hydraulic fracturing fluids from a fourth manifold 214A fluidly connected to a fourth set of frac pumps 122. A second wellbore 230B can receive hydraulic fracturing fluids from a fifth manifold 214B fluidly connected to a fifth set of frac pumps 122. A third wellbore 230C can receive hydraulic fracturing fluids from a sixth manifold 214C fluidly connected to a sixth set of frac pumps 122. The fourth manifold 214A, fifth manifold 214B, and sixth manifold 214C can be fluidly connected to blending unit 219B comprising blender(s) 212. The fracturing fluid produced by the blender(s) 212 via associated water supply 112A and chemical unit 116A can be delivered to the fourth manifold 214A via a feed line 210A, to the fifth manifold 214B via a feed line 210B, and to the sixth manifold 214C via a feed line 210C.

The fracturing units, e.g., the plurality of frac pumps 122, the manifolds, mixing blender(s) 202 and associated proppant storage unit 118, hydration blender 212, water supply unit 112, and chemical unit 116, may comprise a mixture of equipment of different operational characteristics (e.g., models, ages, size, capacity, etc.). A reliability score for each fracturing unit can be maintained based on one or more of the operational characteristics such as size, age, type of equipment, field history, historical service data, time between time between major equipment servicing, or combinations thereof. Pumping proppant laden fluids can be more stressful on the fracturing units, therefore assigning equipment having a higher reliability score (e.g., higher reliability equipment) to pump proppant laden (i.e., dirty) fluids (and conversely assigning equipment having a lower reliability score (e.g., lower reliability equipment) to pump clean fluids) can be advantageous to carrying out a fracturing job by reducing the overall chances of interruption of operations due to equipment failures.

The managing application 136 may assign fracturing equipment with higher reliability score to the first fluid group 250 (comprising dirty manifolds 204A, 204B, and 204C, and related pumps 122) and assign fracturing equipment with a lower reliability score to a second fluid group 260 (comprising clean manifolds 214A, 214B, and 214C, and related pumps 122). The second fluid group 260 can be configured to pump hydraulic fracturing fluids without proppant (i.e., clean fluid).

The managing application 136, executing on a computer system 132, can control the fracturing units/equipment of first fluid group 250 and the second fluid group 260 via the plurality of unit control modules, e.g., 166 in FIG. 6. The first wellbore 230A can receive a portion of the dirty treatment fluid from the first manifold 204A and a portion of the clean treatment fluid from the fourth manifold 214A based on the first pumping sequence. The second wellbore 230B can receive a portion of the dirty treatment fluid from the second manifold 204B and a portion of the clean treatment fluid from the fifth manifold 214B based on the second pumping sequence. The third wellbore 230C can receive a portion of the dirty treatment fluid from the third manifold 204C and a portion of the clean treatment fluid from the sixth manifold 214C based on the third pumping sequence. By splitting the dirty fluid from first fluid group 250 and the clean fluid from second fluid group 260 and combining streams 222A and 226A to form stream 244A, streams 222B and 226B to form stream 244B, and streams 222C and 226C to form stream 244C, the composition, rate, and/or pressure of each fracturing fluid pumped into first wellbore 230A, second wellbore 230B, and third wellbore 230C can be independently controlled and varied in accordance with the applicable pumping sequence. Accordingly, the first wellbore 230A can receive wellbore treatment fluid that is different from the wellbore treatment fluid received by the second wellbore 230B and/or the third wellbore 230C; and/or the third wellbore 230C can receive wellbore treatment fluid that is different from the wellbore treatment fluid received by the second wellbore 230B. For example, the first wellbore 230A may receive 33% of the flowrate volume from blender 202 via the first manifold 204A while the second wellbore 230B receives 40% of the flowrate volume via the second manifold 204B, and the third wellbore 230C receives 27% of the flowrate volume via the third manifold 204C.

As previously described, a combined pumping sequence, e.g., 270 as illustrated in FIG. 8, can be produced by the managing application 136 from a pumping schedule from a first wellbore 230A, a pumping schedule for a second wellbore 230B, and a pumping schedule from a third wellbore 230C (and so on for more than three wellbores 230). The managing application 136 may assign or reassign fracturing equipment to first fluid group 250 (e.g., dirty service) and/or to second fluid group 260 (e.g., clean service) based on a reliability score. The managing application 136 may rank the fracturing equipment based on a reliability score along with other factors, such as capacity, e.g., flowrate and/or pressure. The managing application 136 may assign the fracturing equipment ranked highest in reliability score sequentially to a first fluid group, the dirty fluid group 250 in FIG. 3, until the required pumping capacity is achieved. The managing application may issue an alert if one or more frac units with a reliability score less than a threshold value is assigned to the first fluid group. Fracturing equipment with a higher reliability score may be added from existing inventory or equipment requested from another location, e.g., a neighboring service location. The managing application 136 may assign the remaining fracturing equipment based on reliability score sequentially to the second fluid group, the clean fluid group 260, until the required pumping capacity is achieved. Alternatively, the managing application 136 may assign the remaining fracturing equipment based on reliability score sequentially beginning with the lowest reliability score. The managing application may issue an alert if one or more frac units are incompatible, for example if a manifold will not accommodate enough pumps. The managing application 136 may issue an alert if a reserve pump is not available, e.g., an extra pump delivered to location in case of an equipment malfunction. The managing application may assign one or more of the pumps with the lowest reliability score to be held in reserve.

The managing application 136 may increase utilization of available fracturing equipment by assigning fracturing equipment with the lowest reliability score to the clean fluid group 260 first. The managing application may assign or reassign fracturing equipment to the second fluid group 260, e.g., the clean group, based on the reliability score until the needed pumping capacity is achieved. The managing application may begin with the lowest reliability score and add fracturing units sequentially. The managing application may begin with a nominal lowest reliability score, or average lowest reliability score, and add fracturing units to the second fluid group 260 based on the average reliability score. The managing application 136 may then assign or reassign fracturing equipment with a high reliability to the first fluid group 250, e.g., the dirty fluid group. The managing application 136 may assign the fracturing equipment ranked highest in reliability score sequentially to a first fluid group 250, the dirty fluid group, until the required pumping capacity is achieved. Assigning fracturing equipment with the lowest reliability score to the clean fluid group 260 may increase the overall fracturing fleet equipment utilization.

As discussed previously, the managing application 136 may identify one or more intervals of the combined pumping sequence where the combined flowrate exceeds an operational limit of one or more of the fracturing units (e.g., a potentially problematic interval), and one or more offsets may be introduced into the combined pumping sequence to avoid any such potentially problematic intervals. As discussed previously, the managing application 136 may identify one or more intervals of the combined pumping sequence where the flowrate exceeds an adjusted operational limit (e.g., a potentially problematic interval), and one or more offsets may be introduced into the combined pumping sequence to avoid any such potentially problematic intervals.

In response to a potentially problematic interval, the managing application 136 may lower the operational output of one or more fracturing equipment by offsetting the pumping sequence for the second wellbore 230B and/or the third wellbore 230C (and so on for more than three wellbores 230) from the pumping sequence for the first wellbore 230A. The modified pumping sequence can comprise a first pumping sequence, e.g., flowrate 262A, with a first start time and a second pumping sequence, e.g., flowrate 262B, and/or a third pumping sequence, e.g., flowrate 262C, with a start time delayed for a period of time, thereby lowering the combined output below an operational limit or an adjusted operational limit. The pumping sequence of any one of the three or more wellbores can be delayed or offset relative to the pumping sequence of one or more of the other of the three or more wellbores.

In response to a potentially problematic interval, the managing application 136 may produce a modified combined pumping schedule where the second pumping schedule and/or the third pumping schedule is offset from the start of the first pumping schedule, and/or the third pumping sequence is offset from the start of the second pumping schedule. The managing application 136 may produce a modified combined pumping schedule where a portion of the second pumping schedule and/or the third pumping schedule is offset from the first pumping schedule. The modified combined pumping schedule may lower the combined output below an operational limit or an adjusted operational limit.

In an embodiment, the method is a method of controlling a pumping sequence of a fracturing fleet at a wellsite. The method comprises determining a first pumping sequence for a first wellbore, wherein the first pumping sequence comprises a first plurality of intervals. The method comprises determining a second pumping sequence for a second wellbore and a third pumping sequence for a third wellbore, wherein the second pumping sequence comprises a second plurality of intervals and wherein the third pumping sequence comprises a third plurality of intervals.

The method comprises combining the first pumping sequence, the second pumping sequence, and the third pumping sequence into a combined pumping sequence, wherein the first plurality of intervals overlaps the second plurality of intervals and/or the third plurality of intervals. The method comprises identifying at least one interval wherein the combined pumping sequence exceeds an operating limit of at least one fracturing unit. The method comprises offsetting the intervals from the second pumping sequence and/or the third pumping sequence from the intervals of the first pumping sequence to create a modified combined pumping sequence, wherein the at least one interval of the modified combined pumping sequence is below the operating limit.

The method can further comprise assembling the fracturing fleet at the wellsite and operating the pumps of the fracturing fleet to place one or more fracturing fluids into at least one wellbore per the combined pumping sequence. The method can further comprise establishing electronic communication between a managing application and a plurality of fracturing units located at the wellsite. The method can comprise starting a modified combined pumping sequence, by the managing application, wherein the intervals from the second pumping sequence and/or the third pumping sequence can be offset from the intervals from the first pumping sequence.

The method can further comprise controlling, by the managing application, a first group of fracturing units in accordance with the first pumping sequence. The method can comprise controlling, by the managing application, a second group of fracturing units in accordance with the second pumping sequence and a third group of fracturing units in accordance with the third pumping schedule. The method can comprise pumping a well treatment per the first pumping sequence into the first wellbore. The method can comprise pumping the well treatment per the second pumping sequence into the second wellbore. The method can comprise pumping the well treatment per the third pumping sequence into the third wellbore.

In an embodiment, the method is a method of controlling a pumping sequence of a fracturing fleet at a wellsite. The method comprises identifying an inventory of fracturing units for a pumping operation on three or more (e.g., a first wellbore, a second wellbore, and a third wellbore) from a plurality of available fracturing units.

The method can comprise comparing the inventory of fracturing units to a combined pumping sequence, wherein the combined pumping sequence includes a first pumping sequence, a second pumping sequence, and a third pumping sequence, wherein the first wellbore receives the first pumping sequence, the second wellbore receives the second pumping sequence, and the third wellbore receives the third pumping sequence. The method can comprise assigning a plurality of fracturing units to a first pumping group, wherein the first pumping group comprises a blender/blending unit fluidly connected to a first manifold, a second manifold, and a third manifold (and so on for more than three wellbores) wherein at least one pump is connected to the first manifold, wherein at least one pump is connected to the second manifold, and wherein at least one pump is connected to the third manifold.

The method can comprise connecting a first wellbore to the first manifold. The method can comprise connecting the second wellbore to the second manifold. The method can comprise connecting the third wellbore to the third manifold. The method can comprise offsetting the intervals from one or more of the pumping schedules from the intervals of at least one other pumping schedule to create a modified combined pumping schedule, wherein the operating limit of the first pumping group is not exceeded. For example, the method can comprise offsetting the intervals from the second pumping schedule and/or the third pumping schedule (and so on for more than three wellbores) from the intervals of the first pumping schedule to create a modified combined pumping schedule, wherein the operating limit of the first pumping group is not exceeded.

The method can further comprise assigning a plurality of fracturing units to a second pumping group, wherein the second pumping group comprising a blender/blending unit fluidly connected to a fourth manifold, a fifth manifold, and a sixth manifold, wherein at least one pump is connected to the fourth manifold, wherein at least one pump is connected to the fifth manifold, and wherein at least one pump is connected to the sixth manifold. The method can comprise connecting the first wellbore to the fourth manifold, wherein the first wellbore receives a portion of treatment fluid from the first manifold and a portion of treatment fluid from the fourth manifold. The method can comprise connecting the second wellbore to the fifth manifold, wherein the second wellbore receives a portion of treatment fluid from the second manifold and a portion of treatment fluid from the fifth manifold. The method can comprise connecting the third wellbore to the sixth manifold, wherein the third wellbore receives a portion of treatment fluid from the second manifold and a portion of treatment fluid from the sixth manifold.

The method can further comprise assigning a reliability score to the inventory of fracturing units. The method can comprise assigning fracturing equipment with a higher reliability score to the first pumping group. The reliability score can comprise i) age, ii) maintenance schedule, iii) time between rebuilds, or iv) combination thereof. The method can further comprise modifying the modified pumping sequence based on the reliability score of the frac units assigned to the first pumping group.

FIG. 11 illustrates a computer system 380 suitable for implementing one or more embodiments disclosed herein, for example implementing one or more computers, servers or the like as disclosed or used herein, including without limitation any aspect of the computing system associated with control van 110 (e.g., computer 132); any aspect of a unit level control system as shown in FIG. 2 (e.g., controller 142); etc. The computer system 380 includes a processor 382 (which may be referred to as a central processor unit or CPU) that is in communication with memory devices including secondary storage 384, read only memory (ROM) 386, random access memory (RAM) 388, input/output (I/O) devices 390, and network connectivity devices 392. The processor 382 may be implemented as one or more CPU chips.

It is understood that by programming and/or loading executable instructions onto the computer system 380, at least one of the CPU 382, the RAM 388, and the ROM 386 are changed, transforming the computer system 380 in part into a particular machine or apparatus having the novel functionality taught by the present disclosure. It is fundamental to the electrical engineering and software engineering arts that functionality that can be implemented by loading executable software into a computer can be converted to a hardware implementation by well-known design rules. Decisions between implementing a concept in software versus hardware typically hinge on considerations of stability of the design and numbers of units to be produced rather than any issues involved in translating from the software domain to the hardware domain. Generally, a design that is still subject to frequent change may be preferred to be implemented in software, because re-spinning a hardware implementation is more expensive than re-spinning a software design. Generally, a design that is stable that will be produced in large volume may be preferred to be implemented in hardware, for example in an application specific integrated circuit (ASIC), because for large production runs the hardware implementation may be less expensive than the software implementation. Often a design may be developed and tested in a software form and later transformed, by well-known design rules, to an equivalent hardware implementation in an application specific integrated circuit that hardwires the instructions of the software. In the same manner as a machine controlled by a new ASIC is a particular machine or apparatus, likewise a computer that has been programmed and/or loaded with executable instructions may be viewed as a particular machine or apparatus.

Additionally, after the computer system 380 is turned on or booted, the CPU 382 may execute a computer program or application. For example, the CPU 382 may execute software or firmware stored in the ROM 386 or stored in the RAM 388. In some cases, on boot and/or when the application is initiated, the CPU 382 may copy the application or portions of the application from the secondary storage 384 to the RAM 388 or to memory space within the CPU 382 itself, and the CPU 382 may then execute instructions that the application is comprised of. In some cases, the CPU 382 may copy the application or portions of the application from memory accessed via the network connectivity devices 392 or via the I/O devices 390 to the RAM 388 or to memory space within the CPU 382, and the CPU 382 may then execute instructions that the application is comprised of. During execution, an application may load instructions into the CPU 382, for example load some of the instructions of the application into a cache of the CPU 382. In some contexts, an application that is executed may be said to configure the CPU 382 to do something, e.g., to configure the CPU 382 to perform the function or functions promoted by the subject application. When the CPU 382 is configured in this way by the application, the CPU 382 becomes a specific purpose computer or a specific purpose machine.

The secondary storage 384 is typically comprised of one or more disk drives or tape drives and is used for non-volatile storage of data and as an over-flow data storage device if RAM 388 is not large enough to hold all working data. Secondary storage 384 may be used to store programs which are loaded into RAM 388 when such programs are selected for execution. The ROM 386 is used to store instructions and perhaps data which are read during program execution. ROM 386 is a non-volatile memory device which typically has a small memory capacity relative to the larger memory capacity of secondary storage 384. The RAM 388 is used to store volatile data and perhaps to store instructions. Access to both ROM 386 and RAM 388 is typically faster than to secondary storage 384. The secondary storage 384, the RAM 388, and/or the ROM 386 may be referred to in some contexts as computer readable storage media and/or non-transitory computer readable media.

I/O devices 390 may include printers, video monitors, liquid crystal displays (LCDs), touch screen displays, keyboards, keypads, switches, dials, mice, track balls, voice recognizers, card readers, paper tape readers, or other well-known input devices.

The network connectivity devices 392 may take the form of modems, modem banks, Ethernet cards, universal serial bus (USB) interface cards, serial interfaces, token ring cards, fiber distributed data interface (FDDI) cards, wireless local area network (WLAN) cards, radio transceiver cards, and/or other well-known network devices. The network connectivity devices 392 may provide wired communication links and/or wireless communication links (e.g., a first network connectivity device 392 may provide a wired communication link and a second network connectivity device 392 may provide a wireless communication link). Wired communication links may be provided in accordance with Ethernet (IEEE 802.3), Internet protocol (IP), time division multiplex (TDM), data over cable service interface specification (DOCSIS), wavelength division multiplexing (WDM), and/or the like. In an embodiment, the radio transceiver cards may provide wireless communication links using protocols such as code division multiple access (CDMA), global system for mobile communications (GSM), long-term evolution (LTE), WiFi (IEEE 802.11), Bluetooth, Zigbee, narrowband Internet of things (NB IoT), near field communications (NFC), radio frequency identity (RFID). The radio transceiver cards may promote radio communications using 5G, 5G New Radio, or 5G LTE radio communication protocols. These network connectivity devices 392 may enable the processor 382 to communicate with the Internet or one or more intranets. With such a network connection, it is contemplated that the processor 382 might receive information from the network, or might output information to the network in the course of performing the above-described method steps. Such information, which is often represented as a sequence of instructions to be executed using processor 382, may be received from and outputted to the network, for example, in the form of a computer data signal embodied in a carrier wave.

Such information, which may include data or instructions to be executed using processor 382 for example, may be received from and outputted to the network, for example, in the form of a computer data baseband signal or signal embodied in a carrier wave. The baseband signal or signal embedded in the carrier wave, or other types of signals currently used or hereafter developed, may be generated according to several methods well-known to one skilled in the art. The baseband signal and/or signal embedded in the carrier wave may be referred to in some contexts as a transitory signal.

The processor 382 executes instructions, codes, computer programs, scripts which it accesses from hard disk, floppy disk, optical disk (these various disk based systems may all be considered secondary storage 384), flash drive, ROM 386, RAM 388, or the network connectivity devices 392. While only one processor 382 is shown, multiple processors may be present. Thus, while instructions may be discussed as executed by a processor, the instructions may be executed simultaneously, serially, or otherwise executed by one or multiple processors. Instructions, codes, computer programs, scripts, and/or data that may be accessed from the secondary storage 384, for example, hard drives, floppy disks, optical disks, and/or other device, the ROM 386, and/or the RAM 388 may be referred to in some contexts as non-transitory instructions and/or non-transitory information.

In an embodiment, the computer system 380 may comprise two or more computers in communication with each other that collaborate to perform a task. For example, but not by way of limitation, an application may be partitioned in such a way as to permit concurrent and/or parallel processing of the instructions of the application. Alternatively, the data processed by the application may be partitioned in such a way as to permit concurrent and/or parallel processing of different portions of a data set by the two or more computers. In an embodiment, virtualization software may be employed by the computer system 380 to provide the functionality of a number of servers that is not directly bound to the number of computers in the computer system 380. For example, virtualization software may provide twenty virtual servers on four physical computers. In an embodiment, the functionality disclosed above may be provided by executing the application and/or applications in a cloud computing environment. Cloud computing may comprise providing computing services via a network connection using dynamically scalable computing resources. Cloud computing may be supported, at least in part, by virtualization software. A cloud computing environment may be established by an enterprise and/or may be hired on an as-needed basis from a third party provider. Some cloud computing environments may comprise cloud computing resources owned and operated by the enterprise as well as cloud computing resources hired and/or leased from a third party provider.

In an embodiment, some or all of the functionality disclosed above may be provided as a computer program product. The computer program product may comprise one or more computer readable storage medium having computer usable program code embodied therein to implement the functionality disclosed above. The computer program product may comprise data structures, executable instructions, and other computer usable program code. The computer program product may be embodied in removable computer storage media and/or non-removable computer storage media. The removable computer readable storage medium may comprise, without limitation, a paper tape, a magnetic tape, magnetic disk, an optical disk, a solid state memory chip, for example analog magnetic tape, compact disk read only memory (CD-ROM) disks, floppy disks, jump drives, digital cards, multimedia cards, and others. The computer program product may be suitable for loading, by the computer system 380, at least portions of the contents of the computer program product to the secondary storage 384, to the ROM 386, to the RAM 388, and/or to other non-volatile memory and volatile memory of the computer system 380. The processor 382 may process the executable instructions and/or data structures in part by directly accessing the computer program product, for example by reading from a CD-ROM disk inserted into a disk drive peripheral of the computer system 380. Alternatively, the processor 382 may process the executable instructions and/or data structures by remotely accessing the computer program product, for example by downloading the executable instructions and/or data structures from a remote server through the network connectivity devices 392. The computer program product may comprise instructions that promote the loading and/or copying of data, data structures, files, and/or executable instructions to the secondary storage 384, to the ROM 386, to the RAM 388, and/or to other non-volatile memory and volatile memory of the computer system 380.

In some contexts, the secondary storage 384, the ROM 386, and the RAM 388 may be referred to as a non-transitory computer readable medium or a computer readable storage media. A dynamic RAM embodiment of the RAM 388, likewise, may be referred to as a non-transitory computer readable medium in that while the dynamic RAM receives electrical power and is operated in accordance with its design, for example during a period of time during which the computer system 380 is turned on and operational, the dynamic RAM stores information that is written to it. Similarly, the processor 382 may comprise an internal RAM, an internal ROM, a cache memory, and/or other internal non-transitory storage blocks, sections, or components that may be referred to in some contexts as non-transitory computer readable media or computer readable storage media.

In embodiments, the herein disclosed system and method can be used to extend the operating range of equipment (e.g., of legacy equipment that was not specifically designed for multiple well operations (e.g., simultaneous fracturing of multiple wells)). The herein disclosed system and method can be utilized to maintain operation below a maximum available limit (and/or a target maximum limit below the maximum available limit), by offsetting (e.g., staggering and/or delaying) pumping sequences of multiple wells being simultaneously treated such that a combined pumping sequence is replaced with a modified pumping sequence that maintains the desired operation. In embodiments, the modified pumping sequence provides/exhibits leveled operation relative to the combined pumping sequence.

The herein disclosed system and method can enable, for example, a reduction in a proppant 18 rate required from blending and proppant handling equipment.

In embodiments, the herein disclosed system and method can be used to reduce and/or even out a total proppant rate such that the rate does not exceed the capacity of a forklift, conveyor belt, front end loader, container flipper or rotator for wet sand, and/or the mixing capacity of the blender tub (e.g., 304, 308 of FIG. 4), or overwhelm an operator.

Additional Disclosure

The following are non-limiting, specific embodiments in accordance with the present disclosure:

In a first embodiment, a method of controlling a pumping sequence of a fracturing fleet at a wellsite, comprises: determining a pumping sequence for each of three or more wellbores, wherein each pumping sequence comprises a plurality of intervals; combining the pumping sequences for each of the three or more wellbores into a combined pumping sequence, wherein the plurality of intervals of the pumping sequence of each of the three or more wellbores overlap; and offsetting the intervals from the pumping sequence of one or more of the three or more wellbores from the intervals of the pumping sequence of at least one other of the three or more wellbores to create a modified combined pumping sequence, wherein each of the plurality of intervals of the modified combined pumping sequence is below an operating limit of at least one fracturing unit of the fracturing fleet (e.g., wherein the modified combined pumping sequence reduces at least one operating parameter below that of the combined pumping sequence).

A second embodiment can include the method of the first embodiment further comprising identifying at least one interval wherein the combined pumping sequence exceeds an operating limit of at least one fracturing unit of the fracturing fleet; and wherein the at least one interval of the modified combined pumping sequence is below the operating limit.

A third embodiment can include the method of the first or the second embodiment, wherein offsetting the intervals from the pumping sequence of the one or more of the three or more wellbores from the intervals of the pumping sequence of the at least one other of the three or more wellbores to create the modified combined pumping sequence (e.g., wherein the at least one interval of the modified combined pumping sequence is below the operating limit) further comprises: offsetting the intervals from the pumping sequence of the one or more of the three or more wellbores from the intervals of the pumping sequence of the at least one other of the three or more wellbores to create the modified combined pumping sequence, such that each of the plurality of intervals of the modified combined pumping sequence is below the operating limit by a buffer of at least 10, 20, or 30% of the operating limit.

A fourth embodiment can include the method of the third embodiment, wherein the modified pumping sequence obtained by offsetting the intervals from the pumping sequence of the one or more of the three or more wellbores from the intervals of the pumping sequence of the at least one other of the three or more wellbores to create the modified combined pumping sequence, such that the at least one interval of the modified combined pumping sequence is below the operating limit by a buffer of at least 10, 20, or 30% of the operating limit, exhibits less variability than the modified pumping sequence obtained by offsetting the intervals from the pumping sequence of the one or more of the three or more wellbores from the intervals of the pumping sequence of the at least one other of the three or more wellbores to create the modified combined pumping sequence, wherein the at least one interval of the modified combined pumping sequence is below the operating limit.

A fifth embodiment can include the method of any of the first to fourth embodiments further comprising: establishing electronic communication between a managing application and a plurality of fracturing units located at the wellsite; starting the modified combined pumping sequence, by the managing application; controlling, by the managing application, a group of fracturing units in accordance with each pumping sequence; and pumping, into each wellbore of the three or more wellbores, a well treatment per the pumping sequence for the each wellbore.

A sixth embodiment can include the method of the fifth embodiment further comprising, adjusting one or more pumping sequence on-the-fly, while maintaining the at least one interval of the modified combined pumping sequence below the operating limit.

A seventh embodiment can include the method of the sixth embodiment, wherein adjusting the one or more pumping sequences on-the-fly, while maintaining the at least one interval of the modified combined pumping sequence below the operating limit further comprises increasing or decreasing an operating parameter (e.g., the pumping rate to one of the three or more wellbores, a concentration of proppant, liquid additive, dry additive, etc.), and concomitantly decreasing or increasing, respectively, the operating parameter to one or more other of the three or more wellbores.

An eighth embodiment can include the method of any one of the first to seventh embodiments, wherein offsetting the intervals from the pumping sequence of the one or more of the three or more wellbores from the intervals of the pumping sequence of the at least one other of the three or more wellbores to create the modified combined pumping sequence further comprises offsetting the intervals from the pumping sequence of the one or more of the three or more wellbores from the intervals of the pumping sequence of the at least one other of the three or more wellbores such that the modified pumping sequence is less variable than the combined pumping sequence.

A ninth embodiment can include the method of any one of the first to eighth embodiments, wherein offsetting the intervals from the pumping sequence of the one or more of the three or more wellbores from the intervals of the pumping sequence of the at least one other of the three or more wellbores to create the modified combined pumping sequence further comprises introducing additional transition time between one or more interval and a subsequent interval of the pumping sequence of the at least one other of the three or more wellbores.

A tenth embodiment can include the method of any one of the first to ninth embodiments, wherein the modified combined pumping sequence has less variability than the combined pumping sequence.

An eleventh embodiment can include the method of any one of the first to tenth embodiments, wherein the modified combined pumping sequence is below the operating limit for a duration of the modified combined pumping sequence.

In a twelfth embodiment, a method of controlling a pumping sequence of a fracturing fleet at a wellsite comprises determining a first pumping sequence for a first wellbore, wherein the first pumping sequence comprises a first plurality of intervals; determining a second pumping sequence for a second wellbore, wherein the second pumping sequence comprises a second plurality of intervals; determining a third pumping sequence for a third wellbore, wherein the third pumping sequence comprises a third plurality of intervals; combining the first pumping sequence, the second pumping sequence, and the third pumping sequence into a combined pumping sequence, wherein the first plurality of intervals, the second plurality of intervals, and the third plurality of intervals at least partially overlap; and offsetting the intervals from the second pumping sequence and/or the third pumping sequence from the intervals of the first pumping sequence to create the modified combined pumping sequence, each of the plurality of intervals of the modified combined pumping sequence is below an operating limit of at least one fracturing unit of the fracturing fleet (e.g., wherein the modified combined pumping sequence reduces at least one operating parameter below that of the combined pumping sequence).

A thirteenth embodiment can include the method of the twelfth embodiment further comprising identifying at least one interval wherein the combined pumping sequence exceeds an operating limit of at least one fracturing unit of the fracturing fleet; and wherein the at least one interval of the modified combined pumping sequence is below the operating limit.

A fourteenth embodiment can include the method of the thirteenth embodiment, wherein offsetting the intervals from the second pumping sequence and/or the third pumping sequence from the intervals of the first pumping sequence to create the modified combined pumping sequence further comprises: offsetting the intervals from the second pumping sequence and/or the third pumping sequence from the intervals of the first pumping sequence to create the modified combined pumping sequence, such that the at least one interval of the modified combined pumping sequence is below the operating limit by a buffer of at least 10, 20, or 30% of the operating limit.

A fifteenth embodiment can include the method of the fourteenth embodiment, wherein the modified pumping sequence obtained by offsetting the intervals from the second pumping sequence and/or the third pumping sequence from the intervals of the first pumping sequence to create the modified combined pumping sequence, such that the at least one interval of the modified combined pumping sequence is below the operating limit by a buffer of at least 10, 20, or 30% of the operating limit exhibits less variability than the modified pumping sequence obtained by offsetting the intervals from the pumping sequence of the one or more of the three or more wellbores from the intervals of the pumping sequence of the at least one other of the three or more wellbores to create the modified combined pumping sequence, wherein the at least one interval of the modified combined pumping sequence is below the operating limit.

A sixteenth embodiment can include the method of the fourteenth or fifteenth embodiment further comprising: establishing electronic communication between a managing application and a plurality of fracturing units located at the wellsite; starting the modified combined pumping sequence, by the managing application; controlling, by the managing application, a group of fracturing units in accordance with each pumping sequence; and for each of the three or more wellbores, pumping a well treatment per the pumping sequence for the each wellbore into the each wellbore.

A seventeenth embodiment can include the method of the sixteenth embodiment, wherein the modified combined pumping sequence is below the operating limit for a duration of the pumping.

An eighteenth embodiment can include the method of the sixteenth or seventeenth embodiment further comprising, adjusting one or more pumping sequence on-the-fly, while maintaining the modified combined pumping sequence below the operating limit.

A nineteenth embodiment can include the method of the eighteenth embodiment, wherein adjusting the one or more pumping sequences on-the-fly, while maintaining the modified combined pumping sequence below the operating limit further comprises increasing or decreasing the pumping rate to one of the three or more wellbores, and concomitantly decreasing or increasing, respectively, the pumping rate to one or more other of the three or more wellbores.

A twentieth embodiment can include the method of any one of the twelfth to nineteenth embodiments, wherein offsetting the intervals from the pumping sequence of the one or more of the three or more wellbores from the intervals of the pumping sequence of the at least one other of the three or more wellbores to create the modified combined pumping sequence further comprises: offsetting the intervals from the pumping sequence of the one or more of the three or more wellbores from the intervals of the pumping sequence of the at least one other of the three or more wellbores such that the modified pumping sequence is less variable than the combined pumping sequence.

A twenty first embodiment can include the method of any one of the twelfth to twentieth embodiments, wherein offsetting the intervals from the pumping sequence of the one or more of the three or more wellbores from the intervals of the pumping sequence of the at least one other of the three or more wellbores to create the modified combined pumping sequence further comprises introducing additional transition time between one or more interval and a subsequent interval of the pumping sequence of the at least one other of the three or more wellbores.

A twenty second embodiment can include the method of any one of the twelfth to twenty first embodiments, wherein the modified combined pumping sequence has less variability than the combined pumping sequence.

A twenty third embodiment can include the method of any one of the twelfth to twenty second embodiments, wherein the at least one interval comprises a volume of fluid of the pumping sequence or a time property of the pumping sequence.

A twenty fourth embodiment can include the method of any one of the twelfth to twenty third embodiments further comprising; assembling the fracturing fleet at the wellsite; and operating the pumps of the fracturing fleet to place one or more fracturing fluids into at least one wellbore per the combined pumping sequence.

A twenty fifth embodiment can include the method of any one of the twelfth to twenty fourth embodiments, wherein: the fracturing unit comprises a fracturing pump, a manifold, a blending unit, a hydration blender, a proppant storage unit, a chemical unit, or a water supply unit.

A twenty sixth embodiment can include the method of any one of the twelfth to twenty fifth embodiments, wherein offsetting the intervals comprises starting a modified interval of the second pumping sequence and/or the third pumping sequence after a portion of the first pumping sequence finishes, wherein the interval comprises a volume of fluid or a time property of the modified combined pumping sequence.

A twenty seventh embodiment can include the method of any one of the twelfth to twenty sixth embodiments further comprising: establishing electronic communication between a managing application and a plurality of fracturing units located at the wellsite; starting the modified combined pumping sequence, by the managing application, wherein the intervals from the second pumping sequence and/or the third pumping sequence are offset from the intervals from the first pumping sequence; controlling, by the managing application, a first group of fracturing units in accordance with the first pumping sequence; controlling, by the managing application, a second group of fracturing units in accordance with the second pumping sequence; controlling, by the managing application, a third group of fracturing units in accordance with the third pumping sequence; pumping a well treatment per the first pumping sequence into the first wellbore; pumping the well treatment per the second pumping sequence into the second wellbore; and pumping the well treatment per the third pumping sequence into the third wellbore.

A twenty eighth embodiment can include the method of the twenty seventh embodiment further comprising: receiving, by the managing application, notification of an operational value exceeding a threshold within a current interval of the modified combined pumping sequence from at least one sensor associated with each of the plurality of fracturing units; and modifying the modified combined pumping sequence, by the managing application, in response to the notification, to complete the current interval below the operating limit of the fracturing units.

In a twenty ninth embodiment, a method of controlling a pumping sequence of a fracturing fleet at a wellsite comprises: identifying an inventory of fracturing units for a pumping operation on three or more wellbores from a plurality of available fracturing units; comparing the inventory of fracturing units to a combined pumping sequence, wherein the combined pumping sequence includes a pumping sequence for each of the three or more wellbores, wherein each of the three or more wellbores receives the pumping sequence for the each of the three or more wellbores; assigning a plurality of fracturing units to a first pumping group, wherein the first pumping group comprises a blending unit fluidly connected to three or more manifolds, wherein at least one pump is connected to each of the three or more manifolds; connecting each wellbore of the three or more wellbores to one of the three or more manifolds; and offsetting a plurality of intervals from the pumping sequence for one or more of the three or more wellbores from a plurality of intervals of the pumping sequence for one or more other of the three or more wellbores to create a modified combined pumping sequence, wherein the operating limit of the first pumping group is not exceeded.

A thirtieth embodiment can include the method of the twenty ninth embodiment comprising: identifying an inventory of fracturing units for a pumping operation on a first wellbore, a second wellbore, and a third wellbore of the three or more wellbores from the plurality of available fracturing units; comparing the inventory of fracturing units to the combined pumping sequence, wherein the combined pumping sequence includes a first pumping sequence, a second pumping sequence, and a third pumping sequence, wherein the first wellbore receives the first pumping sequence, wherein the second wellbore receives the second pumping sequence, and wherein the third wellbore receives the third pumping sequence; assigning a plurality of fracturing units to the first pumping group, wherein the first pumping group comprises the blending unit fluidly connected to a first manifold, a second manifold, and a third manifold, wherein at least one pump is connected to the first manifold, wherein at least one pump is connected to the second manifold, and wherein at least one pump is connected to the third manifold; connecting the first wellbore to the first manifold; connecting the second wellbore to the second manifold; connecting the third manifold to the third wellbore; and offsetting a second plurality of intervals from the second pumping sequence and/or a third plurality of intervals from the third pumping sequence from a first plurality of intervals of the first pumping sequence to create the modified combined pumping sequence, wherein the operating limit of the first pumping group is not exceeded.

A thirty first embodiment can include the method of the thirtieth embodiment further comprising: assigning a plurality of fracturing units to a second pumping group, wherein the second pumping group comprising a clean blender fluidly connected to a fourth manifold, a fifth manifold, and a sixth manifold, wherein at least one pump is connected to the fourth manifold, wherein at least one pump is connected to the fifth manifold, wherein at least one pump is connected to the sixth manifold, and wherein the clean blender is a mix blender or a boost pump; connecting the first wellbore to the fourth manifold, wherein the first wellbore receives a portion of treatment fluid from the first manifold and a portion of treatment fluid from the fourth manifold; and connecting the second wellbore to the fifth manifold, wherein the second wellbore receives a portion of treatment fluid from the second manifold and a portion of treatment fluid from the fifth manifold; and connecting the third wellbore to the sixth manifold, wherein the third wellbore receives a portion of treatment fluid from the third manifold and a portion of treatment fluid from the sixth manifold.

A thirty second embodiment can include the method of the thirty first embodiment, wherein: the first manifold and fourth manifold are low pressure side manifolds for a combination manifold, wherein the first wellbore receives the treatment fluid from the unitary combination manifold output; the second manifold and fifth manifold are low pressure side manifolds for a combination manifold, wherein the second wellbore receives the treatment fluid from the unitary combination manifold output; and/or the third manifold and sixth manifold are low pressure side manifolds for a combination manifold, wherein the third wellbore receives the treatment fluid from the unitary combination manifold output.

A thirty third embodiment can include the method of any one of the twenty ninth to thirty second embodiments further comprising: assigning a reliability score to the inventory of fracturing units; and assigning fracturing equipment with a higher reliability score to the first pumping group, wherein the reliability score comprises i) age, ii) maintenance schedule, iii) time between rebuilds, or iv) combination thereof.

A thirty fourth embodiment can include the method of the thirty third embodiment further comprising: modifying the modified pumping sequence based on the reliability score of the frac units assigned to the first pumping group.

A thirty fifth embodiment can include the method of any one of the twenty ninth to thirty fourth embodiments, wherein the first pumping group includes a proppant storage unit fluidly connected to the blender.

A thirty sixth embodiment can include the method of any one of the thirtieth to thirty fifth embodiments, wherein the plurality of assigned fracturing units are assigned to the first fluid group sequentially based on the reliability score beginning with the highest reliability score.

A thirty seventh embodiment can include the method of any one of the twenty ninth to thirty sixth embodiments, wherein offsetting the intervals from the pumping sequence of the one or more of the three or more wellbores from the intervals of the pumping sequence of the at least one other of the three or more wellbores to create the modified combined pumping sequence, wherein the at least one interval of the modified combined pumping sequence is below the operating limit further comprises: offsetting the intervals from the pumping sequence of the one or more of the three or more wellbores from the intervals of the pumping sequence of the at least one other of the three or more wellbores to create the modified combined pumping sequence, such that the at least one interval of the modified combined pumping sequence is below the operating limit by a buffer of at least 10, 20, or 30% of the operating limit.

A thirty eighth embodiment can include the method of the thirty seventh embodiment, wherein the modified pumping sequence obtained by offsetting the intervals from the pumping sequence of the one or more of the three or more wellbores from the intervals of the pumping sequence of the at least one other of the three or more wellbores to create the modified combined pumping sequence, such that the at least one interval of the modified combined pumping sequence is below the operating limit by a buffer of at least 10, 20, or 30% of the operating limit exhibits less variability than the modified pumping sequence obtained by offsetting the intervals from the pumping sequence of the one or more of the three or more wellbores from the intervals of the pumping sequence of the at least one other of the three or more wellbores to create the modified combined pumping sequence, wherein the at least one interval of the modified combined pumping sequence is below the operating limit.

A thirty ninth embodiment can include the method of the thirty seventh or thirty eighth embodiment further comprising: establishing electronic communication between a managing application and a plurality of fracturing units located at the wellsite; starting the modified combined pumping sequence, by the managing application; controlling, by the managing application, a group of fracturing units in accordance with each pumping sequence; and pumping, into each of the three or more wellbores, a well treatment per the pumping sequence for the each of the three or more wellbores.

A fortieth embodiment can include the method of the thirty ninth embodiment further comprising, adjusting one or more pumping sequence on-the-fly, while maintaining the at least one interval of the modified combined pumping sequence below the operating limit.

A forty first embodiment can include the method of the fortieth embodiment, wherein adjusting the one or more pumping sequences on-the-fly, while maintaining the at least one interval of the modified combined pumping sequence below the operating limit further comprises increasing or decreasing the pumping rate to one of the three or more wellbores, and concomitantly decreasing or increasing, respectively, the pumping rate to one or more other of the three or more wellbores.

A forty second embodiment can include the method of any one of the twenty ninth to forty first embodiments, wherein offsetting the intervals from the pumping sequence of the one or more of the three or more wellbores from the intervals of the pumping sequence of the at least one other of the three or more wellbores to create the modified combined pumping sequence, wherein the at least one interval of the modified combined pumping sequence is below the operating limit further comprises wherein offsetting the intervals from the pumping sequence of the one or more of the three or more wellbores from the intervals of the pumping sequence of the at least one other of the three or more wellbores such that the modified pumping sequence is less variable than the combined pumping sequence.

A forty third embodiment can include the method of any one of the twenty ninth to forty second embodiments, wherein offsetting the intervals from the pumping sequence of the one or more of the three or more wellbores from the intervals of the pumping sequence of the at least one other of the three or more wellbores to create the modified combined pumping sequence, wherein the at least one interval of the modified combined pumping sequence is below the operating limit further comprises introducing additional transition time between one or more interval and a subsequent interval of the pumping sequence of the at least one other of the three or more wellbores.

A forty fourth embodiment can include the method of any one of the twenty ninth to forty third embodiments, wherein the modified combined pumping sequence has less variability than the combined pumping sequence.

A forty fifth embodiment can include the method of any one of the twenty ninth to forty fourth embodiments, wherein the modified combined pumping sequence is below the operating limit for an entire duration of simultaneous treatment of the three or more wellbores.

In a forty sixth embodiment, a fracturing fleet system at a wellsite comprises: a first pumping group comprising a blender fluidly connected to a first manifold, a second manifold, and a third manifold, wherein at least one pump is connected to the first manifold, wherein at least one pump is connected to the second manifold, and wherein at least one pump is connected to the third manifold; a first wellbore fluidly connected to the first manifold; a second wellbore fluidly connected to the second manifold; a third wellbore fluidly connected to the second manifold; a managing application, executing on a computer system, controlling a plurality of frac units, wherein the managing application is communicatively connected to the frac units via a plurality of unit control modules, and wherein the plurality of unit control modules are configured to control the frac units; wherein the managing application is configured to perform the following: loading a first pumping sequence for a first wellbore, wherein the first pumping sequence comprises a plurality of intervals; loading a second pumping sequence for a second wellbore, wherein the second pumping sequence comprises a plurality of intervals; loading a third pumping sequence for a third wellbore, wherein the third pumping sequence comprises a plurality of intervals; combining the first pumping sequence, the second pumping sequence, and the third pumping sequence into a combined pumping sequence, wherein the first plurality of intervals, the second plurality of intervals, and the third plurality of intervals at least partially overlap; and offsetting the intervals of the first pumping sequence, the second pumping sequence, and/or the third pumping sequence to create a modified combined pumping sequence, wherein each of the plurality of intervals of the modified combined pumping sequence is below an operating limit of at least one fracturing unit of the fracturing fleet (e.g., wherein the modified combined pumping sequence reduces at least one operating parameter below that of the combined pumping sequence).

A forty seventh embodiment can include the fracturing fleet system of the forty sixth embodiment, wherein the managing application is further configured for identifying at least one interval wherein the combined pumping sequence exceeds an operating limit of at least one fracturing unit of the fracturing fleet; and wherein the at least one interval of the modified combined pumping sequence is below the operating limit.

A forty eighth embodiment can include the fracturing fleet system of the forty seventh embodiment further comprising: a second pumping group comprising a clean blender fluidly connected to a fourth manifold, a fifth manifold, and a sixth manifold, wherein at least one pump is connected to the fourth manifold, at least one pump is connected to the fifth manifold, at least one pump is connected to the sixth manifold, and the clean blender is a mixing blender or a boost pump; the first wellbore fluidly connected to the fourth manifold; the second wellbore fluidly connected to the fifth manifold; and the third wellbore fluidly connected to the sixth manifold.

A forty ninth embodiment can include the fracturing fleet system of the forty eighth embodiment, wherein: the first wellbore receives a portion of treatment fluid from the first manifold and a portion of treatment fluid from the fourth manifold; the second wellbore receives a portion of treatment fluid from the second manifold and a portion of treatment fluid from the fifth manifold; and the third wellbore receives a portion of treatment fluid from the third manifold and a portion of treatment fluid from the sixth manifold.

A fiftieth embodiment can include the fracturing fleet system of any one of the forty sixth to forty ninth embodiments further comprising a proppant storage unit fluidly connected to the blender.

A fifty first embodiment can include the fracturing fleet system of any one of the forty sixth to fiftieth embodiments, wherein the first wellbore receives proppant slurry from the first manifold, the second wellbore receives proppant slurry from the second manifold, and the third wellbore receives proppant slurry from the third manifold.

A fifty second embodiment can include the fracturing fleet system of any one of the forty sixth to fifty first embodiments, wherein the at least one interval comprises a volume of fluid of the pumping sequence or a time property of the pumping sequence.

A fifth third embodiment can include the fracturing fleet system of any one of the forty sixth to fifty second embodiments, wherein the fracturing unit comprises a fracturing pump, a manifold, a blending unit, a hydration blender, a proppant storage unit, a chemical unit, or a water supply unit.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, RI, and an upper limit, Ru, is disclosed, any number falling within the range is specifically disclosed. In particular, the following numbers within the range are specifically disclosed: R=RI+k*(Ru−RI), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A method of controlling a pumping sequence of a fracturing fleet at a wellsite, the method comprising:

determining a first pumping sequence for a first wellbore, wherein the first pumping sequence comprises a first plurality of intervals;

determining a second pumping sequence for a second wellbore, wherein the second pumping sequence comprises a second plurality of intervals;

determining a third pumping sequence for a third wellbore, wherein the third pumping sequence comprises a third plurality of intervals;

combining the first pumping sequence, the second pumping sequence, and the third pumping sequence into a combined pumping sequence, wherein the first plurality of intervals, the second plurality of intervals, and the third plurality of intervals at least partially overlap; and temporally offsetting the intervals from the second pumping sequence and/or the third pumping sequence from the intervals of the first pumping sequence to create the modified combined pumping sequence, each of the plurality of intervals of the modified combined pumping sequence is below a preselected operating limit of an operating parameter of at least one fracturing unit of the fracturing fleet, wherein the preselected operating limit is below an ultimate maximum capability of the at least one fracturing unit, or minimizes the operating parameter of at least one fracturing unit of the fracturing fleet, wherein the at least one fracturing unit comprises a fracturing pump, a manifold, a blending unit, a hydration blender, a proppant storage unit, a chemical unit, or a water supply unit, and wherein each of the plurality of intervals of the modified combined pumping sequence minimizes the operating parameter of the at least one fracturing unit of the fracturing fleet.

2. The method of claim 1 further comprising identifying at least one interval wherein the combined pumping sequence exceeds an operating limit of at least one fracturing unit of the fracturing fleet; and wherein the at least one interval of the modified combined pumping sequence is below the operating limit.

3. The method of claim 1, wherein temporally offsetting the intervals from the second pumping sequence and/or the third pumping sequence from the intervals of the first pumping sequence to create the modified combined pumping sequence further comprises:

temporally offsetting the intervals from the second pumping sequence and/or the third pumping sequence from the intervals of the first pumping sequence to create the modified combined pumping sequence, such that each of the plurality of intervals of the modified combined pumping sequence is below the operating limit by a buffer of at least 10, 20, or 30% of the operating limit.

4. The method of claim 3, wherein the modified pumping sequence obtained by temporally offsetting the intervals from the second pumping sequence and/or the third pumping sequence from the intervals of the first pumping sequence to create the modified combined pumping sequence exhibits less variability in the operating parameter than the modified pumping sequence obtained by temporally offsetting the intervals from the pumping sequence of the one or more of the three or more wellbores from the intervals of the pumping sequence of the at least one other of the three or more wellbores to create the modified combined pumping sequence.

5. The method of claim 3 further comprising:

establishing electronic communication between a managing application and a plurality of fracturing units located at the wellsite;

starting the modified combined pumping sequence, by the managing application;

controlling, by the managing application, a group of fracturing units in accordance with each pumping sequence; and for each of the three or more wellbores, pumping a well treatment per the pumping sequence for the each wellbore into the each wellbore.

6. The method of claim 1 further comprising;

assembling the fracturing fleet at the wellsite; and operating the pumps of the fracturing fleet to place one or more fracturing fluids into at least one wellbore per the combined pumping sequence.

7. The method of claim 1 further comprising:

establishing electronic communication between a managing application and a plurality of fracturing units located at the wellsite;

starting the modified combined pumping sequence, by the managing application, wherein the intervals from the second pumping sequence and/or the third pumping sequence are offset from the intervals from the first pumping sequence;

controlling, by the managing application, a first group of fracturing units in accordance with the first pumping sequence;

controlling, by the managing application, a second group of fracturing units in accordance with the second pumping sequence;

controlling, by the managing application, a third group of fracturing units in accordance with the third pumping sequence;

pumping a well treatment per the first pumping sequence into the first wellbore;

pumping the well treatment per the second pumping sequence into the second wellbore; and pumping the well treatment per the third pumping sequence into the third wellbore.

8. The method of claim 7 further comprising:

receiving, by the managing application, notification of an operational value exceeding a threshold within a current interval of the modified combined pumping sequence from at least one sensor associated with each of the plurality of fracturing units; and modifying the modified combined pumping sequence, by the managing application, in response to the notification, to complete the current interval below the operating limit of the fracturing units.

9. A fracturing fleet system at a wellsite, comprising:

a first pumping group comprising a blender fluidly connected to a first manifold, a second manifold, and a third manifold, wherein at least one pump is connected to the first manifold, wherein at least one pump is connected to the second manifold, and wherein at least one pump is connected to the third manifold;

a second pumping group comprising a clean blender fluidly connected to a fourth manifold, a fifth manifold, and a sixth manifold, wherein at least one pump is connected to the fourth manifold, at least one pump is connected to the fifth manifold, at least one pump is connected to the sixth manifold, and the clean blender is a mixing blender or a boost pump;

wherein the first manifold and the fourth manifold are configured to fluidly connect to a first wellbore;

wherein the second manifold and the fifth manifold are configured to fluidly connect to a second wellbore; and wherein the third manifold and the sixth manifold are configured to fluidly connect to a third wellbore;

a managing application, executing on a computer system, controlling a plurality of fracturing units, wherein the managing application is communicatively connected to the fracturing units via a plurality of unit control modules, and wherein the plurality of unit control modules are configured to control the fracturing units;

wherein the managing application is configured to perform the following:

loading a first pumping sequence for the first wellbore, wherein the first pumping sequence comprises a plurality of intervals;

loading a second pumping sequence for the second wellbore, wherein the second pumping sequence comprises a plurality of intervals;

loading a third pumping sequence for the third wellbore, wherein the third pumping sequence comprises a plurality of intervals;

combining the first pumping sequence, the second pumping sequence, and the third pumping sequence into a combined pumping sequence, wherein the first plurality of intervals, the second plurality of intervals, and the third plurality of intervals at least partially overlap; and temporally offsetting the intervals of the first pumping sequence, the second pumping sequence, and/or the third pumping sequence to create a modified combined pumping sequence, wherein each of the plurality of intervals of the modified combined pumping sequence is below a preselected operating limit of an operating parameter at least one fracturing unit of the fracturing fleet, wherein the preselected operating limit is below an ultimate maximum capability of the at least one fracturing unit, or minimizes the operating parameter of at least one fracturing unit of the fracturing fleet, wherein the at least one fracturing unit comprises a fracturing pump, a manifold, a blending unit, a hydration blender, a proppant storage unit, a chemical unit, or a water supply unit.

10. The fracturing fleet system of claim 9, wherein the managing application is further configured for identifying at least one interval wherein the combined pumping sequence exceeds an operating limit of at least one fracturing unit of the fracturing fleet; and wherein the at least one interval of the modified combined pumping sequence is below the operating limit.

11. The fracturing fleet system of claim 9, wherein;

the first wellbore receives a portion of treatment fluid from the first manifold and a portion of treatment fluid from the fourth manifold;

the second wellbore receives a portion of treatment fluid from the second manifold and a portion of treatment fluid from the fifth manifold; and the third wellbore receives a portion of treatment fluid from the third manifold and a portion of treatment fluid from the sixth manifold.

12. A method of controlling a pumping sequence of a fracturing fleet at a wellsite, comprising:

determining a pumping sequence for each of three or more wellbores, wherein each pumping sequence comprises a plurality of intervals;

combining the pumping sequences for each of the three or more wellbores into a combined pumping sequence, wherein the plurality of intervals of the pumping sequence of each of the three or more wellbores overlap; and temporally offsetting the intervals from the pumping sequence of one or more of the three or more wellbores from the intervals of the pumping sequence of at least one other of the three or more wellbores to create a modified combined pumping sequence, wherein each of the plurality of intervals of the modified combined pumping sequence is below a preselected operating limit of an operating parameter of at least one fracturing unit of the fracturing fleet, wherein the preselected operating limit minimizes the operating parameter of at least one fracturing unit of the fracturing fleet, wherein the at least one fracturing unit comprises a fracturing pump, a manifold, a blending unit, a hydration blender, a proppant storage unit, a chemical unit, or a water supply unit, and wherein each of the plurality of intervals of the modified combined pumping sequence minimizes the operating parameter of the at least one fracturing unit of the fracturing fleet.

13. The method of claim 12 further comprising identifying at least one interval wherein the combined pumping sequence exceeds an operating limit of at least one fracturing unit of the fracturing fleet; and wherein the at least one interval of the modified combined pumping sequence is below the operating limit.

14. The method of claim 12, wherein temporally offsetting the intervals from the pumping sequence of the one or more of the three or more wellbores from the intervals of the pumping sequence of the at least one other of the three or more wellbores to create the modified combined pumping sequence further comprises:

temporally offsetting the intervals from the pumping sequence of the one or more of the three or more wellbores from the intervals of the pumping sequence of the at least one other of the three or more wellbores to create the modified combined pumping sequence, such that each interval of modified combined pumping sequence is below the operating limit by a buffer of at least 10, 20, or 30% of the operating limit.

15. The method of claim 12 further comprising:

establishing electronic communication between a managing application and a plurality of fracturing units located at the wellsite;

starting the modified combined pumping sequence, by the managing application;

controlling, by the managing application, a group of fracturing units in accordance with each pumping sequence; and pumping, into each wellbore of the three or more wellbores, a well treatment per the pumping sequence for the each wellbore.

16. The method of claim 15 further comprising, adjusting one or more pumping sequence on-the-fly, while maintaining the at least one interval of the modified combined pumping sequence below the operating limit.

17. The method of claim 12, wherein temporally offsetting the intervals from the pumping sequence of the one or more of the three or more wellbores from the intervals of the pumping sequence of the at least one other of the three or more wellbores to create the modified combined pumping sequence further comprises temporally offsetting the intervals from the pumping sequence of the one or more of the three or more wellbores from the intervals of the pumping sequence of the at least one other of the three or more wellbores such that the modified pumping sequence exhibits less variability in the operating parameter than the combined pumping sequence.

18. The method of claim 12, wherein temporally offsetting the intervals from the pumping sequence of the one or more of the three or more wellbores from the intervals of the pumping sequence of the at least one other of the three or more wellbores to create the modified combined pumping sequence further comprises introducing additional transition time between one or more interval and a subsequent interval of the pumping sequence of the at least one other of the three or more wellbores.

19. The method of claim 12, wherein the modified combined pumping sequence exhibits less variability in the operating parameter than the combined pumping sequence.

20. The method of claim 12, wherein the operating parameter comprises a total flow rate.

* * * * *